US010109243B2

(12) United States Patent
Kang

(10) Patent No.: US 10,109,243 B2
(45) Date of Patent: Oct. 23, 2018

(54) DISPLAY APPARATUS, LED DRIVING CIRCUIT AND CONTROL FOR ADJUSTING DRIVING VOLTAGE BASED ON DIFFERENCE BETWEEN REFERENCE CURRENT AND TOTAL DRIVING CURRENT

(71) Applicant: SAMSUNG ELECTRONICS CO., LTD., Suwon-si, Gyeonggi-do (KR)

(72) Inventor: Jeong-il Kang, Yongin-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 128 days.

(21) Appl. No.: 15/017,967

(22) Filed: Feb. 8, 2016

(65) Prior Publication Data

US 2017/0004778 A1 Jan. 5, 2017

(30) Foreign Application Priority Data

Jul. 3, 2015 (KR) ..... 10-2015-0095549

(51) Int. Cl.

| | |
|---|---|
| ***G09G 5/10*** | (2006.01) |
| ***G09G 3/34*** | (2006.01) |
| ***H05B 33/08*** | (2006.01) |

(52) U.S. Cl.

CPC ..... *G09G 3/3426* (2013.01); *H05B 33/086* (2013.01); *H05B 33/0827* (2013.01); *G09G 2330/025* (2013.01)

(58) Field of Classification Search

CPC . G09G 3/3426; H05B 33/0827; H05B 33/086

(Continued)

(56) References Cited

U.S. PATENT DOCUMENTS

2004/0208011 A1* 10/2004 Horiuchi ..... G09G 3/30 362/458

2009/0251071 A1 10/2009 Gater et al.

(Continued)

FOREIGN PATENT DOCUMENTS

KR 10-2007-0000963 1/2007
KR 10-2014-0104580 8/2014

*Primary Examiner* — Jonathan Blancha
(74) *Attorney, Agent, or Firm* — Nixon & Vanderhye P.C.

(57) ABSTRACT

Disclosed is a display apparatus comprising: a signal receiver configured to receive an image signal; a signal processor configured to process the received image signal; a display comprising a display panel which displays an image based on the processed image signal, and a plurality of light emitting diode (LED) groups each of which comprises a plurality of LEDs connected in series and the LED groups being connected in parallel with each other to emit light for an image to be displayed on the panel in accordance with a driving current; a plurality of switches respectively provided in the LED groups and selectively cutting off flow of a driving current in each LED group; a voltage adjuster configured to apply a driving voltage to the plurality of LED groups; and a controller configured to control the plurality of switches so that the driving current can flow in the LED group to be driven among the plurality of LED groups, and to control the voltage adjuster so that the applied driving voltage can have a preset level based on the number of LED groups to be driven and a level of a total driving current flowing in the plurality of LED groups and sensed by a current sensor.

Thus, local dimming of the display apparatus is controlled by one controller; thereby a display apparatus of which circuit is simplified and material costs has been decreased compared to the case where a plurality of controller control local dimming is provided.

22 Claims, 20 Drawing Sheets

(58) Field of Classification Search
USPC ..... 345/691
See application file for complete search history.

(56) References Cited

U.S. PATENT DOCUMENTS

| | | | | |
|---|---|---|---|---|
| 2011/0012521 | A1* | 1/2011 | Byun | G09G 3/3406 315/186 |
| 2011/0204798 | A1 | 8/2011 | Cusinato et al. | |
| 2012/0050697 | A1* | 3/2012 | Suzuki | G03B 21/20 353/85 |
| 2013/0099671 | A1* | 4/2013 | Horino | H05B 37/02 315/122 |
| 2014/0191674 | A1 | 7/2014 | Baddela et al. | |
| 2015/0061528 | A1 | 3/2015 | Raval et al. | |
| 2015/0154917 | A1* | 6/2015 | Jung | H05B 33/0815 345/102 |
| 2016/0205735 | A1* | 7/2016 | Heimes | H05B 33/0812 315/77 |

* cited by examiner

DISPLAY APPARATUS, LED DRIVING CIRCUIT AND CONTROL FOR ADJUSTING DRIVING VOLTAGE BASED ON DIFFERENCE BETWEEN REFERENCE CURRENT AND TOTAL DRIVING CURRENT

CROSS-REFERENCE TO RELATED APPLICATION

This application is based on and claims priority under 35 U.S.C. § 119 to Korean Patent Application No. 10-2015-0095549, filed on Jul. 3, 2015 in the Korean Intellectual Property Office, the disclosure of which is incorporated by reference herein in its entirety.

BACKGROUND

Field

Apparatuses and methods of the disclosure relate to a display apparatus with a local dimming backlight and a control method thereof, and for example to a display apparatus, a light emitting diode (LED) driving circuit and a method of controlling the same, in which a plurality of local dimming backlight blocks is driven and controlled by one controller, thereby decreasing complication of the circuit and reducing material costs.

Description of Related Art

A display apparatus including a display panel displays an image based on a broadcast signal or an image signal/image data of various formats, and is achieved by a television (TV), a monitor, etc. The display panel may be variously achieved by a liquid crystal display panel, a plasma display panel, etc. in accordance with its characteristics, and used for various display apparatuses. Recently, a liquid crystal display (LCD) has been employed as a display device for a display panel in various fields from a screen for a smart phone to a screen for a large LCD TV. Since the LCD is a non light emitting element, the LCD needs a backlight for illumination in order to display an image.

The backlight for the LCD is required to make generally uniform brightness, be thin and lightweight in the case of a portable LCD, and have low power consumption. The backlight currently used for the LCD includes a light emitting diode (LED), an electro luminescent device (EL), a cold cathode fluorescent lamp (CCFL), an external electrode fluorescent lamp (EEFL), a flat lamp (FL), etc.

Among them, the LED has been in the limelight as the backlight for the LCD since it consumes less power than the CCFL, solves a problem of the EL having a short lifespan, and reduces environmental pollution due to mercury that is a main material for the fluorescent lamp and has recently become an issue.

Further, to improve the quality of an image displayed on the LCD, local dimming technology, for example, dividing backlight into a plurality of blocks for individual dimming control, has been widespread. Thus, the backlight is divided into a plurality of areas, and the brightness is decreased in the areas corresponding to a dark color of an image and increased in the areas corresponding to a bright color of the image in association with an image signal, thereby improving not only contrast but also distinction. In addition, the plurality of areas are driven in sequence through the local dimming, thereby decreasing a motion blur.

For local dimming, a light guide plate that uniformly guides incident light to the display panel, the backlight that is evenly divided into blocks and emits light, and a control driver that is provided in each block and drives the backlight, are required. As the number of divided or sectioned blocks increases, the control drivers respectively provided in the blocks result in a complicated circuit, increase material costs, and increase production costs of the display apparatus.

SUMMARY

An aspect of one or more example embodiments may provide a display apparatus, an LED driving circuit and a control method thereof, in which one controller is efficiently used for local dimming of respective divided or sectioned backlight blocks, thereby simplifying a circuit and decreasing material costs.

According to an aspect of an example embodiment, there is provided a display apparatus comprising: a signal receiver configured to receive an image signal; a signal processor configured to process the received image signal; a display including a display panel configured to display an image based on the processed image signal, and a plurality of light emitting diode (LED) groups each of which comprises a plurality of LEDs connected in series, wherein each of said groups are connected in parallel with each other to emit light for an image to be displayed on the panel in accordance with a driving current; a plurality of switches respectively provided in the LED groups configured to selectively cut off flow of a driving current in each LED group; voltage adjusting circuitry configured to apply a driving voltage to the plurality of LED groups; a current sensor configured to sense a total driving current flowing into the plurality of LED groups; and a controller configured to control the plurality of switches so that the driving current can flow in the LED group to be driven among the plurality of LED groups, and to control the voltage adjusting circuitry so that the applied driving voltage can have a preset level based on the number of LED groups to be driven and a level of a total driving current flowing in the plurality of LED groups sensed by the current sensor.

The controller may be configured to control the voltage adjusting circuitry to adjust the level of the driving voltage based on a level of a reference current corresponding to the number of LED groups to be driven and the sensed level of the total driving current, thus, it is possible to adjust the level of the driving voltage in consideration of the level of the reference current and the level of the total driving current, which vary depending on the number of LED groups to be driven.

The controller may be configured to generate a reference current having a level corresponding to the number of LED groups to be driven, based on a combination of a basic level of the reference current and a counted value corresponding to the number of LED groups to be driven, thus, the level of the reference current corresponds to the number of LED groups to be driven.

The controller may comprise a mixer configured to receive a count signal corresponding to the counted value and a basic level signal corresponding to a basic level of the reference current, and to output a reference current level signal corresponding to the count signal and the level of the reference current, thus, the reference current is generated to have a level corresponding to the count value, e.g., the number of LED groups to be driven and the level of the input basic reference current, thereby outputting the reference current level signal.

The controller may comprise a memory configured to store information about the level of the reference current corresponding to the number of LED groups to be driven, thus, the reference current is generated to have a level corresponding to the counted value without any input of the basic reference current level.

The controller may comprise a first control signal output configured to output a plurality of switching control signals for controlling the plurality of switches corresponding to the LED groups to be driven, thus, it is possible to effectively control the switch to selectively form the current path.

The first control signal output may further output a signal level corresponding to the level of the generated reference current, thus, it is possible to generate the reference current having a level based on the number of LED groups to be driven, and eliminate the mixer.

The controller may further comprise a counter configured to count the number of LED groups to be driven thus, the counter detects the number of LED groups.

The controller may comprise an amplifier configured to output a differential signal having a level corresponding to difference between the level of the reference current and the sensed level of the total driving current; and a second control signal output configured to output a control signal to the voltage adjusting circuit to adjust the level of the driving voltage based on the level of the differential signal, thus, it is possible to compare the level of the reference current and the level of the total driving current, and adjust the driving voltage based on comparison results.

The control signal may comprise a pulse width modulation (PWM) signal having a duty cycle corresponding to the level of the differential signal, thus, the voltage adjusting circuitry can adjust the driving voltage in accordance with the duty cycle of the PWM signal.

The controller may further comprise a delay circuit configured to delay timing of opening and closing the plurality of switches for a predetermined time thus, it is possible to synchronize the timing of forming the current path in each LED group with the timing of increasing or decreasing the driving current, thereby prolonging the lifespan of the LED.

The controller may further comprise a delay circuit configured to delay at least one of opening timing and closing timing for the plurality of switches, thus, it is possible to eliminate and/or reduce a spark due to the current suddenly increased in each LED group, thereby prolonging the lifespan of the LED.

According to an aspect of an example embodiment, there is provided an method of controlling a display apparatus comprising a plurality of light emitting diode (LED) groups connected in parallel with each other and emitting light for an image display in accordance with a driving current, and a driving circuit for driving the plurality of LED groups, the method comprising: applying a driving voltage to the plurality of LED groups; controlling a plurality of switches respectively provided in the LED groups so that a driving current can selectively flow in an LED group to be driven among the plurality of LED groups; sensing a total driving current flowing in the plurality of LED groups; and controlling the applied driving voltage to have a preset level based on the number of LED groups to be driven and a level of the sensed total driving current.

Controlling the level of the driving voltage may comprise controlling the level of the driving voltage based on a level of a reference current corresponding to the number of LED groups to be driven and the sensed level of the total driving current, thus, it is possible to adjust the level of the driving voltage in consideration of the level of the reference current and the level of the total driving current, which may vary depending on the number of LED groups to be driven.

Controlling the level of the driving voltage may comprise generating the reference current having a level corresponding to the number of LED groups to be driven, based on a combination of a basic level of the reference current and a counted value corresponding to the number of LED groups to be driven, thus, the level of the reference current corresponds to the number of LED groups to be driven.

Generating the reference current may comprise: receiving a count signal corresponding to the counted value and a basic level signal corresponding to a basic level of the reference current; and outputting a reference current level signal corresponding to the level of the reference current, thus, the reference current is generated to have a level corresponding to the count value, e.g., the number of LED groups to be driven and the level of the input basic reference current, thereby outputting the reference current level signal.

Generating the reference current may comprise storing information about the level of the reference current corresponding to the number of LED groups to be driven, thus, the reference current is generated to have a level corresponding to the counted value without any input of the basic reference current level.

Controlling the level of the driving voltage may comprise outputting a plurality of switching control signals for controlling the plurality of switches corresponding to the LED groups to be driven, thus, it is possible to effectively control the switch to selectively form the current path.

Controlling the level of the driving voltage may comprise outputting a level signal corresponding to the level of the generated reference current, thus, it is possible to generate the reference current having a level based on the number of LED groups to be driven, and eliminate the operation of outputting the signal.

Generating the reference current may comprise counting the number of LED groups to be driven, thus, the counter detects the number of LED groups.

Controlling the level of the driving voltage may comprise: outputting a differential signal having a level corresponding to difference between the level of the reference current and the sensed level of the total driving current; and outputting a control signal to adjust the level of the driving voltage based on the level of the differential signal, thus, it is possible to compare the level of the reference current and the level of the total driving current, and adjust the driving voltage based on comparison results.

The control signal may comprise a PWM signal having a duty cycle corresponding to the level of the differential signal, thus, it is possible to control the level of the driving voltage in accordance with the duty cycle of the PWM signal.

Controlling the plurality of switches may comprise delaying timing of opening and closing the plurality of switches for a predetermined time, thus, making it possible to synchronize the timing of forming the current path in each LED group with the timing of increasing or decreasing the driving current, thereby prolonging the lifespan of the LED.

Controlling the plurality of switches may comprise delaying at least one of opening timing and closing timing for the plurality of switches, thus, making it possible to synchronize the timing of forming the current path in each LED group with the timing of increasing or decreasing the driving current, thereby prolonging the lifespan of the LED.

Controlling the plurality of switches may comprise delaying at least one of the opening timing and the closing timing for the plurality of switches if the number of LEDs to be driven is decreased, thus, it is possible to reduce and/or eliminate a spark due to the current suddenly increased in each LED group, thereby prolonging the lifespan of the LED.

According to an aspect of an example embodiment, there is provided a light emitting diode (LED) driving circuit used as a light source for a display apparatus to drive a plurality of light emitting diode (LED) groups, each group comprising a plurality of LEDs connected in series and each group being connected in parallel with each other to emit light for an image display on the display apparatus in accordance with a driving current, the LED driving circuit comprising: a plurality of switches configured to be respectively provided in the LED groups and to selectively cut off flow of a driving current in each LED group; a current sensor configured to sense a total driving current flowing in the plurality of LED groups; voltage adjusting circuitry configured to apply a driving voltage to the plurality of LED groups; and a controller configured to control the plurality of switches so that the driving current can flow in the LED group to be driven among the plurality of LED groups, and to control the voltage adjusting circuitry so that the applied driving voltage can have a preset level based on the number of LED groups to be driven and a level of a total driving current sensed by the current sensor The controller is configured to control the voltage adjusting circuitry to adjust the level of the driving voltage based on a level of a reference current corresponding to the number of LED groups to be driven and the sensed level of the total driving current, thus, it is possible to adjust the level of the driving voltage in consideration of the level of the reference current and the level of the total driving current, which may vary depending on the number of LED groups to be driven.

The controller is configured to generate the reference current having a level corresponding to the number of LED groups to be driven, based on a combination of a basic level of the reference current and a counted value corresponding to the number of LED groups to be driven, thus, the level of the reference current corresponds to the number of LED groups to be driven.

The controller may comprise a mixer configured to receive a count signal corresponding to the counted value and a basic level signal corresponding to a basic level of the reference current, and to output a reference current level signal corresponding to the count signal and the level of the reference current, thus, the reference current may be generated to have a level corresponding to the count value, e.g., the number of LED groups to be driven and the level of the input basic reference current, thereby outputting the reference current level signal.

The controller may comprise a memory configured to store information about the level of the reference current corresponding to the number of LED groups to be driven, thus, the reference current is generated to have a level corresponding to the counted value without requiring input of the basic reference current level.

The controller may comprise a first control signal output configured to output a plurality of switching control signals for controlling the plurality of switches corresponding to the LED groups to be driven, thus, it is possible to effectively control the switch to selectively form the current path.

The first control signal output may further output a level signal corresponding to the level of the generated reference current, thus, it is possible to generate the reference current having a level based on the number of LED groups to be driven, and eliminate the mixer.

The controller may further comprise a counter configured to count the number of LED groups to be driven, thus, the counter detects the number of LED groups.

The controller may also comprise: an amplifier configured to output a differential signal having a level corresponding to a difference between the level of the reference current and the sensed level of the total driving current; and a second control signal output configured to output a control signal to the voltage adjusting circuitry to adjust the level of the driving voltage based on the level of the differential signal, thus, it is possible to compare the level of the reference current and the level of the total driving current, and adjust the driving voltage based on comparison results.

The control signal comprises a PWM signal having a duty cycle corresponding to the level of the differential signal, thus, the voltage adjusting circuitry can adjust the driving voltage in accordance with the duty cycle of the PWM signal.

The LED driving circuit may further comprise a delay circuit configured to delay timing of opening and closing the plurality of switches for a predetermined time, thus, making it possible to synchronize the timing of forming the current path in each LED group with the timing of increasing or decreasing the driving current, thereby prolonging the lifespan of the LED.

The LED driving circuit may further comprise a delay circuit configured to delay at least one of opening timing and closing timing for the plurality of switches, thus, making it possible to synchronize the timing of forming the current path in each LED group with the timing of increasing or decreasing the driving current, thereby prolonging the lifespan of the LED.

The delay circuit is configured to delay at least one of the opening timing and the closing timing for the plurality of switches if the number of LEDs to be driven is decreased, thus, it is possible to reduce and/or eliminate a spark due to the current suddenly increased in each LED group, thereby prolonging the lifespan of the LED.

BRIEF DESCRIPTION OF THE DRAWINGS

The above and/or other aspects will become apparent and more readily appreciated from the following detailed description, taken in conjunction with the accompanying drawings, in which like reference numerals refer to like elements, and wherein.

DETAILED DESCRIPTION

A display apparatus, an LED driving circuit and a control method thereof, in which one controller is efficiently used for local dimming each of every sectioned backlight blocks, will be described in detail below with reference to accompanying drawings.

Figure 1:
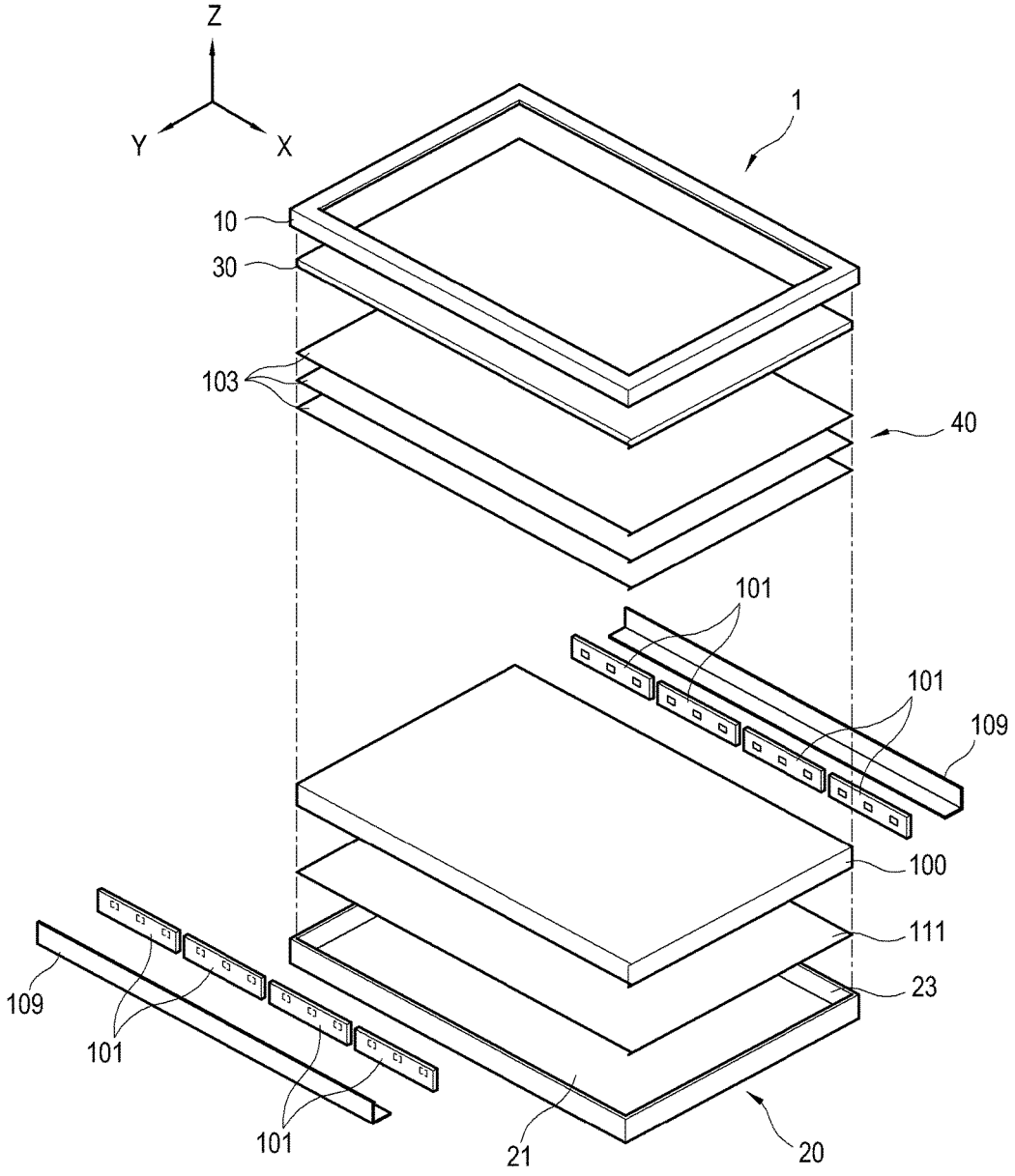
FIG. 1 is an exploded perspective view illustrating an example display apparatus.

FIG. 1 is an exploded perspective view illustrating an example display apparatus 1. This example is related to a display panel 30 that cannot emit light by itself and may be applied to, for example, the display apparatus 1 in which the display panel 30 has an LCD structure.

As illustrated in FIG. 1, the display apparatus 1 processes an image signal received from the exterior, and displays the processed image. Since the display apparatus 1 may be achieved by a television (TV), a monitor, a portable multimedia player, a mobile phone, and the like various devices, the type of the display apparatus is not limited as long as the display apparatus comprises a display panel 30 to display and image.

The display apparatus 1 includes covers 10 and 20 forming an accommodating space inside of the display apparatus 1, the display panel 30 is accommodated in the accommodating space formed by the covers 10 and 20 and displays an image thereon, and a backlight unit 40 is accommodated in the accommodating space and illuminates the display panel 30 so that an image can be displayed on the display panel 30.

Arrows shown in FIG. 1 are as follows. The arrows X, Y and Z refer to directions of width, length and height, respectively. The display panel 30 is arranged on an X-Y plane, and the backlight unit 40 and the display panel 30 are stacked in a direction of Z. Below, the drawings including FIG. 1 and the example embodiments will be described referring to these directions. Here, opposite directions to the directions of X, Y and Z will be respectively represented by −X, −Y and −Z, and the X-Y plane refers to a plane formed by an axis of the X direction and an axis of the Y direction.

The covers 10 and 20 form an outer appearance of the display apparatus 1, and accommodate the display panel 30 and the backlight unit 40. The covers 10 and 20 include an upper cover 10 and a lower cover 20 which cover the display panel 30 and the backlight unit 40 from the top and bottom, respectively.

The upper cover 10 and the lower cover 20 together form the accommodating space and accommodate the display panel 30 and the backlight unit 40 in the accommodating space. A surface of the upper cover 10 parallel with the X-Y plane is formed with an opening through which a display area of the display panel 30 is exposed.

The lower cover 20 is opened upward, i.e. in the Z direction to accommodate the backlight unit 40 therein. In the lower cover 20, the backlight unit 40 is stacked on the bottom surface 21 facing the Z direction, and supported by a lateral wall 23 standing from the bottom surface 21 in the Z direction.

The display panel 30 according to this example embodiment is achieved, for example, by an LCD panel. In the display panel 30, a liquid crystal layer is sandwiched in between two substrates, and orientation of liquid crystal in the liquid crystal layer is adjusted by a driving signal to thereby display an image. If the display panel 30 cannot emit light by itself, the display panel 30 has to receive light from the backlight unit 40 in order to enable an image display on the display area to be seen. The display area refers to an area of the display panel 30, which is in parallel with the X-Y plane and displays an image.

The display panel 30 may include a driving circuit board and the liquid crystal of the display panel 30 is rotated at a predetermined angle when a driving signal is provided from the driving circuit board. Thus, cells, which constitute the display area of the display panel 30, are different in light transmittance, and make an image be displayed on the display area.

The backlight unit 40 is disposed at the rear or bottom of the display panel 30 so as to illuminate the display panel 30. The backlight unit 40 includes a light guide plate 100 for illuminating the display area of the display panel 30, a light source module 101 arranged at an edge region of the display apparatus 1 and emitting light to a lateral side of the light guide plate 100, a reflecting plate 111 stacked on the bottom of the light guide plate 100 and returning light toward the display panel 30, optical sheets 103 adjusting characteristics of the light illuminated by the light guide plate 100, and an intermediate bracket 109 placed in between the light source module 101 and the lower cover 20.

The light guide plate 100 may, for example, be a plastic molding lens formed by acryl injection molding or the like, and substantially evenly guides incident light from the light source module 101 to the entire display area of the display panel 30.

The light guide plate 100 may, for example, be formed with a light guide plate pattern or an optical pattern on the bottom surface thereof facing the reflecting plate 111 in order to scatter light, thereby improving the evenness of the light exiting from the light guide plate 100 and controlling the quantity of exiting light. In other words, the brightness of the display area may be varied depending on how the optical pattern is formed.

In this example embodiment, the light guide plate 100 has a size and shape corresponding to those of the display panel 30, and is divided into a plurality of regions for local dimming. Further, light-guide shielding films may be formed in between the plurality of areas in the light guide plate 100. By forming the light-guide shielding films in the light guide plate 100, the light guide plate 100 may be sectioned or divided into the plurality of areas and illuminated with the light source modules 101 respectively provided on the lateral sides of the sectioned regions to thereby perform local dimming.

The light source module 101 generates light to illuminate the display panel 30. The light source module 101 is arranged in the edge region of the backlight unit 30 along the lateral side of the light guide plate. The light source module 101 is assigned with a certain numeral corresponding to the sectioned region of the light guide plate 100, and arranged standing so that the emitted light can enter the lateral side of the light guide plate 100.

Referring to FIG. 1, three light source modules 101 are provided in each sectioned region at the edges in the Y and −Y direction of the light guide plate 100, but this is just an illustrative embodiment, and the number, position and the like of the light source modules 101 do not limit the scope of the disclosure.

The light emitted from the light source module 101 enters the light guide plate 100 in the direction of Y or −Y, exits from the light guide plate 100 in the direction of Z, and enters the display panel 30. Thus, the display panel 30 can display an image on the display area parallel with the X-Y plane.

In this example embodiment, the light source module 101 may employ a light emitting diode (LED) as a light source.

The reflecting plate 111 concentrates light on the liquid crystal, and reduces and/or prevents loss of the light. The reflecting plate 111 may, for example, be made of poly ethylene (PE), poly ethylene terephthalate (PET) or the like.

At least one of the optical sheets 103 are stacked on the rear of the display panel 30 in parallel with the display panel 30. The optical sheets 103 may, for example, include a prism sheet, a diffusion sheet, a protection film, etc. and together adjust a characteristic of light diffused by a diffusion plate, thereby providing adjusted light to the display panel 30.

The intermediate bracket 109 is installed in the edge region of the lower cover 20 while being in contact with the light source module 101. The intermediate bracket 109 may, for example, include a metal material having a high thermal conductivity, to dissipate heat generated from the light source module 101 efficiently.

Figure 2:
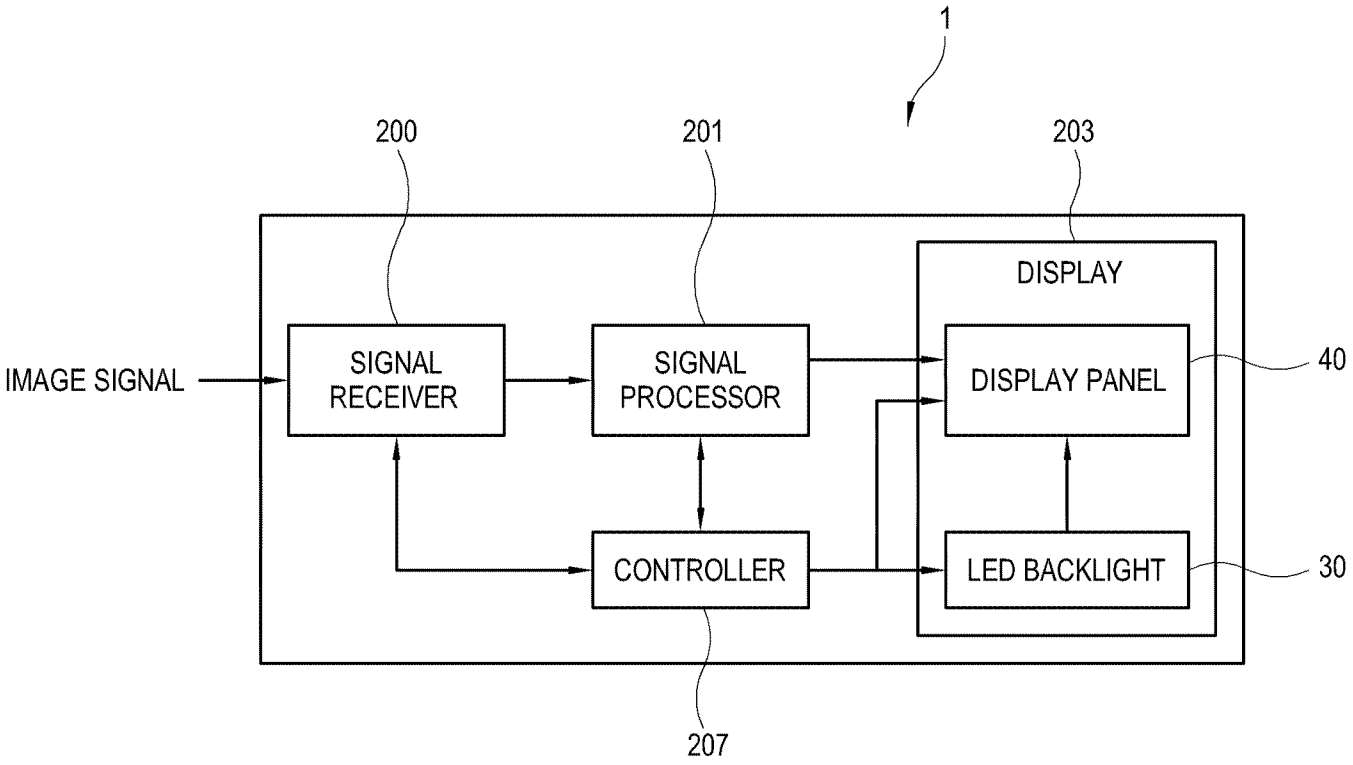
FIG. 2 is a block diagram illustrating an example display apparatus.

The interior of the example display apparatus 1 will be described with reference to FIG. 2. FIG. 2 is a block diagram illustrating the example display apparatus 1. The display apparatus 1 includes a signal receiver 200 configured to receive an external signal, a signal processor 201 configured to process the received external signal, a controller 207, and a display 203 to display an image based on the external signal processed by the signal processor 201.

The signal receiver 200 includes a tuner to receive a signal such as an image signal from the outside. The tuner can be tuned to one channel selected among a plurality of channels under control of the controller 207 and receive an image signal of the tuned channel. Alternatively, the signal receiver 200 may receive an image signal from an imaging device such as a set-top box, a digital versatile disc (DVD), a personal computer (PC), etc., may receive an image signal from a smartphone or the like peripheral device, or may receive an image signal from a server through Internet or the like network.

The signal processor 201 processes the received image signal to be displayed as an image on the display 203. The signal processor 201 may perform image processing such as modulation, demodulation, multiplexing, demultiplexing, analog-digital conversion, digital-analog conversion, decoding, encoding, image enhancement, scaling, etc. to the received image signal.

The display 203 displays an image based on the image signal processed by the signal processor 201. As described above, the display 203 in this example embodiment includes the display panel 30 for displaying an image based on the processed image signal and the backlight unit 40 for illuminating the display panel 30.

The controller 207 is configured to perform various controlling with regard to various elements of the display apparatus 1. For example, the controller 207 may be configured to control the signal receiver 200, the signal processor 201 and the display 203 to process the image signal received though the signal receiver 200 and display the processed image on the display 203. The controller 207 may also be configured to control the backlight unit 40 to perform local dimming. For example, as described above, the backlight unit 40 in this illustrative embodiment may include the light guide plate 100 sectioned or divided into a plurality of regions for local dimming, and the light source module 101 arranged in each sectioned region edge of the light guide plate 100. The controller 207 is configured to divisionally drive each region, for example, to increase the brightness in a bright portion of an image displayed on the display panel 30 or to decrease the brightness in a dark portion, thereby improving not only contrast but also distinction.

Figure 3:
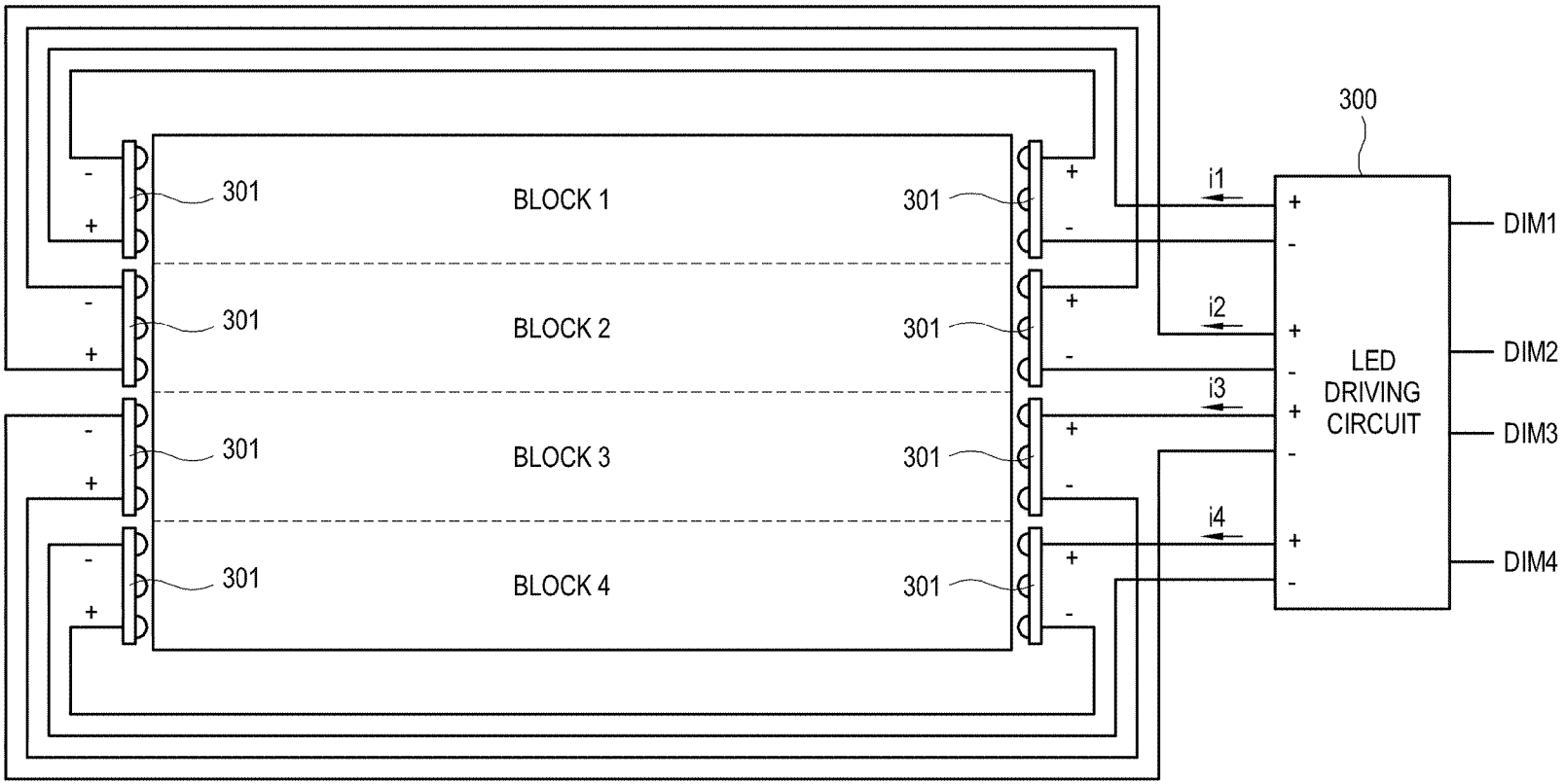
FIG. 3 is a diagram illustrating an example structure of a backlight unit.

FIG. 3 illustrates an example structure of the backlight unit 40. The backlight unit 40 includes the light guide plate 100 and the light source module 101 to illuminate the bottom surface of the display panel 30 (see FIG. 1). The backlight unit 40 may further include an LED driving circuit 300 for driving the light source module 101.

The light source module 101 includes LED groups 301 arranged in each sectioned region edge of the light guide plate 100. A light source of the light source module 101 is achieved, for example, by a light emitting diode (LED), and the LED group 301 including a plurality of LEDs connected in series corresponding to each sectioned region of the light guide plate 100 mounted to a substrate. The LED groups 301 are connected in parallel with each other, and each of the LED groups 301 may, for example, include the same number of LEDs or has the same forward-bias voltage applied for driving all LEDs in the group.

The LED groups 301 are arranged in the respective sectioned regions along the edges of the display panel. In this example embodiment, a section number of the light guide plate 100 is determined corresponding to a total number of LEDs, and at least one LED is placed at and emits light to the lateral side according to the sections of the light guide plate 100 divided into a plurality of regions. The light guide plate 100 may, for example, be sectioned into a plurality of regions by cutting a groove with a predetermined thickness or spacing out the regions of the light guide plate 100 predetermined distances apart.

The LED driving circuit 300 is configured to control the local dimming of the LED groups 301. The LED driving circuit 300 supplies driving power and a dimming control signal to the LED groups 301.

The structure, effects, control method and the like of the LED driving circuit 300 for controlling the local dimming of the LED groups 301 will be described according to an example embodiment.

Figure 4:
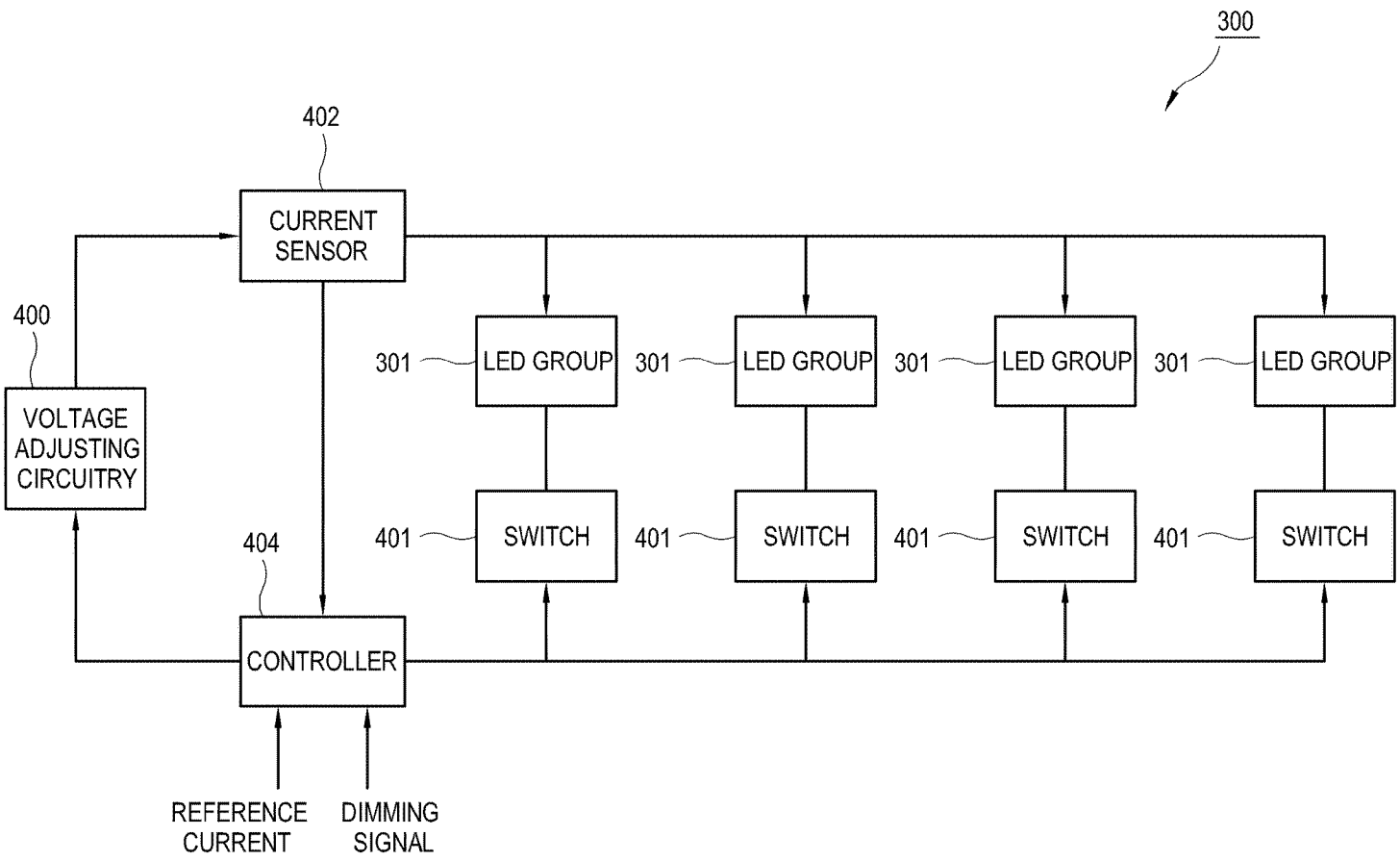
FIG. 4 is a block diagram illustrating an example LED driving circuit.
Figure 5:
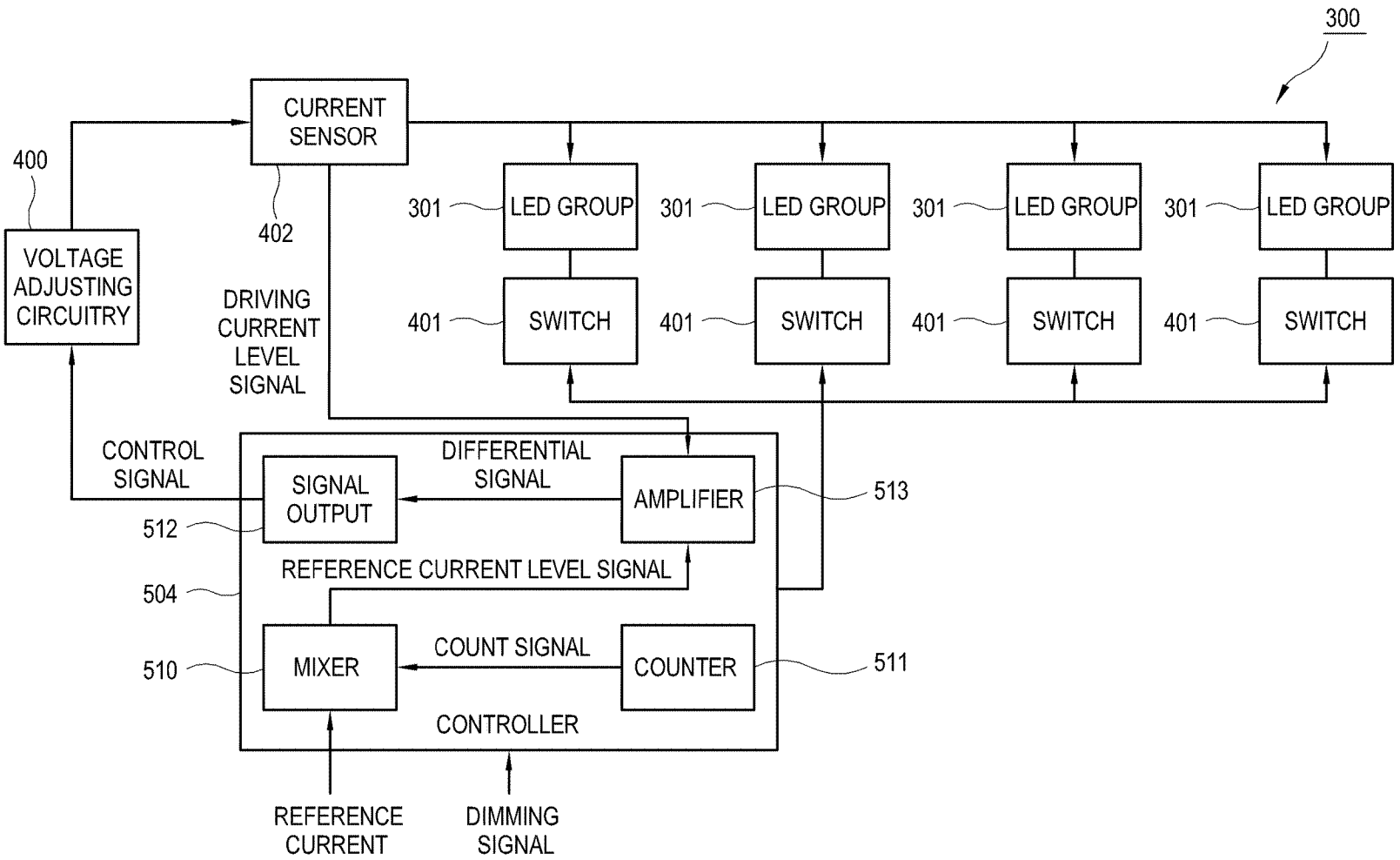
FIG. 5 is a block diagram illustrating an example LED driving circuit.
Figure 6:
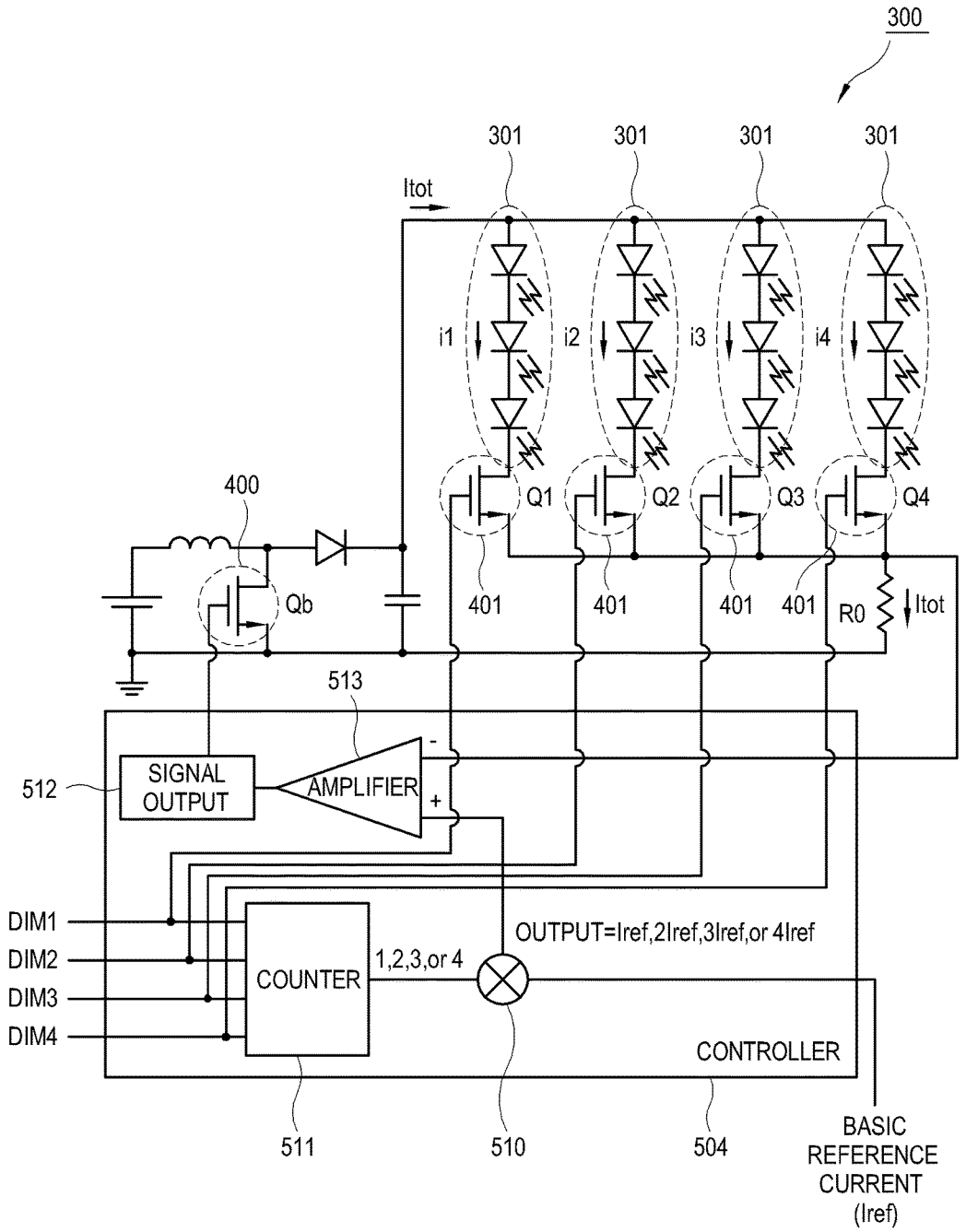
FIG. 6 is a circuit diagram illustrating an example LED driving circuit.

FIGS. 4, 5 and 6 are block diagrams and a circuit diagram illustrating an example LED driving circuit and plurality of LED groups.

The LED driving circuit 300 is a device for driving local dimming of the LED groups 301. Referring to FIG. 4, the LED driving circuit 300 according to an example embodiment includes a plurality of switches 401 for selectively cutting off flow of a driving current in each LED group 301, a current sensor 402 for sensing a total driving current flowing in the plurality of LED groups, a voltage adjuster in the form of voltage adjusting circuitry 400 for applying a driving voltage to the plurality of LED groups, and a controller 404.

The switch 401 provided in each LED group 301 performs a switching operation for selectively forming a current path so that the driving current can flow in the LED group 301 to be driven in accordance with an applied dimming signal. The switch 401 may, for example, be achieved by a metal oxide semiconductor field effect transistor (MOSFET) which can quickly form or cut off the current path in accordance with applied voltage levels.

The current sensor 402 serves to sense a level of a total driving current Itot flowing in all the plurality of LED groups 301. The current sensor 402 senses the level of the total driving current Itot flowing in a resistor Ro (not shown) positioned at a node where the current paths of the LED groups 301 meet, and outputs a total driving current level signal corresponding to the sensed level of the total driving current Itot to the controller 504. In this example embodiment, the current sensor 402 is provided as a separate element for convenience of description, alternatively, the controller 404 may also be configured to perform the role of the current sensor 402.

The voltage adjusting circuitry 400 serves to apply a driving voltage having a preset level to the plurality of LED groups under control of the controller 404. For example, the voltage adjusting circuitry 400 may be achieved by a MOSFET, and adjusts the level of the driving voltage into a preset level based on a duty cycle of a pulse width modulation (PWM) signal received from the controller 404.

According to an example embodiment, the controller 404 is configured to control general operations of the LED driving circuit 300. For example, the controller 404 is configured to control the switching operations of the plurality of switches 401, and to control the voltage adjusting circuitry 400 to adjust the level of the driving voltage based on the number of LED groups 301 to be driven and the sensed level of the total driving current Itot.

Referring to FIG. 5, the controller 504 may include a counter 511 for counting the number of LED groups 301 to be driven, a mixer 510 for generating a reference current Iref having a level based on the counted number, an amplifier 513 for comparing the level of the generated reference current Iref with the level of the total driving current Itot, and a signal output 512 for outputting a control signal to make the voltage adjusting circuitry 400 adjust the level of the driving voltage based on the comparison result output by the amplifier 513.

The counter 511 counts the number of LED groups 301 to be driven based on the dimming signal, and outputs a count signal corresponding to the counted number of LED groups 301 to be driven.

The mixer 510 generates the reference current Iref having a level based on the count signal received from the counter 511 and a basic reference current Iref received from the exterior, and outputs a reference current level signal corresponding to the level of the generated reference current Iref. In this example embodiment, the basic reference current Iref has a level required for driving one LED group 301, and the mixer 510 generates the reference current Iref having a level as high as a product of the number of LED groups 301 to be driven and the level of the basic reference current Iref, and outputting the corresponding reference current level signal, but is not so limited, and the mixer 510 can be achieved by various means.

The amplifier 513 generates and outputs a differential signal corresponding to a difference between the levels of the reference current Iref and the level of the total driving current Itot, based on the reference current level signal received from the mixer 510 and the total driving current level signal received from the current sensor 402. The amplifier 513 may, for example, include a differential amplifier that amplifies and outputs the difference between the signals received from different terminals. In this example embodiment, if the level of the reference current Iref is higher than the level of the total driving current Itot, the amplifier 513 outputs a positive differential signal, and if the level of the reference current Iref is lower than the level of the total driving current Itot, the amplifier 513 outputs a negative differential signal, however, the differential signal output from the amplifier 513 is not limited to this example.

The signal output 512 outputs a control signal to the voltage adjusting circuitry 400 which is configured to adjust the level of the driving voltage based on the differential signal received from the amplifier 513. The signal output 512 may correspond to a first control signal output or a second control signal output described above. The control signal may be a PWM signal having duty cycle corresponding to the level of the differential signal. For example, the signal output 512 widens the duty cycle of the PWM signal by, for example, as much as the level corresponding to the differential signal if the positive differential signal is input, and narrows the duty cycle of the PWM signal by, for example, as much as the level corresponding to the differential signal if the negative differential signal is input, thereby outputting the PWM signal to the voltage adjusting circuitry 400.

The voltage adjusting circuitry 400 raises or lowers the level of the driving voltage in accordance with the duty width of the PWM signal output from the signal output 512. In this example embodiment, the voltage adjusting circuitry 400 adjusts the driving voltage so that the level of the total driving current Itot can be equal or substantially equal to the level of the reference current Iref input to the amplifier 513.

At least one of the LED groups 301 is first driven by the driving voltage output from the voltage adjusting circuitry 400, and the total driving current Itot flowing in all the LED groups 301 is sensed by the current sensor 402. If the dimming signal is applied from the exterior, the counter 511 counts the number of LED groups 301 to be driven, and outputs a corresponding count signal to the mixer 510. The mixer 510 generates the reference current Iref having a level based on the level signal of the basic reference current Iref received from the exterior and the count signal, and outputs the corresponding level signal of the reference current Iref. The amplifier 513 compares the level of the reference current Iref and the level of the total driving current Itot based on the level signal of the reference current Iref received from the mixer 510 and the level signal of the total driving current Itot received from the current sensor 402, and outputs the differential signal corresponding to the level difference to the signal output 512. The signal output 512 makes the voltage adjusting circuitry 400 adjust the driving voltage so that the level of the total driving current Itot can be equal or substantially equal to the level of the reference current Iref.

For example, if two LED groups 301 are being driven, the voltage adjusting circuitry 400 is applying the driving voltage to the two LED groups 301 so that the total driving current Itot can have a level of 2*IRef. By the current divider rule, the total driving current Itot is divided so that the driving current flowing in each LED group 301 can have a level of IRef. Then, if the dimming signal is input to drive three of the LED groups 301, the counter 511 outputs a count signal corresponding to three and the mixer 510 generates and outputs the reference current Iref having a level of 3*IRef based on three and the level of the basic reference current Iref. The amplifier 513 compares the reference current Iref having the level of 3*IRef and the total driving current Itot having the level of 2*IRef, and outputs the differential signal corresponding to the differential level of +IRef to the signal output 512. The signal output 512 widens the duty cycle of the PWM signal as much as IRef and outputs the PWM signal to the voltage adjusting circuitry 400, and the voltage adjusting circuitry 400 adjusts the level of the driving voltage based on the input PWM signal so that the total driving current Itot can have a level of 3*IRef. The switch 401 forms the current path so that three among the LED groups 301 can be driven in response to the input dimming signal. Then, the total driving current Itot is divided so that the driving current flowing in each LED group 301 can have a level of IRef.

Figure 7:
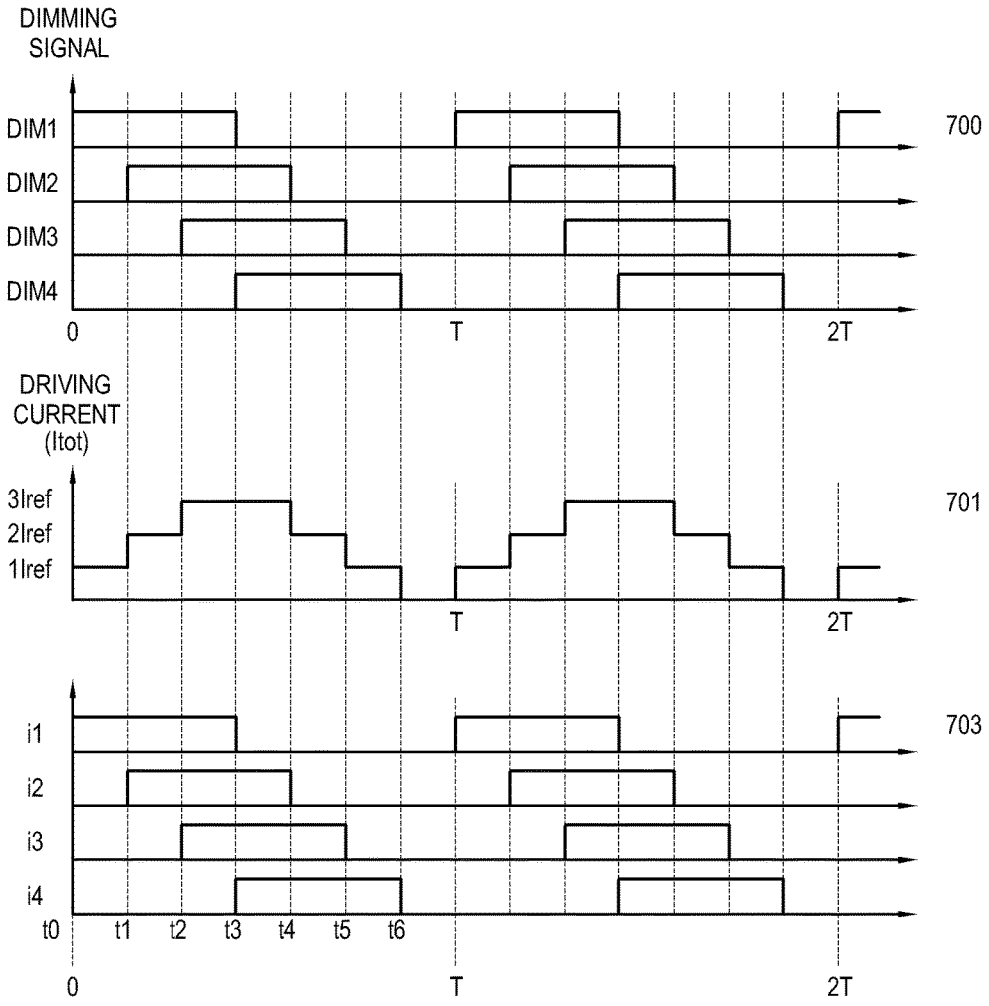
FIG. 7 illustrates an example ideal change in waveforms of a dimming signal, a total driving current, and a current flowing in each LED group.

Change based on the dimming signal in the level of the total driving current Itot flowing in the plurality of LED groups 301 and the current flowing in each LED group will be described with reference to FIG. 7. FIG. 7 illustrates an example ideal change in waveforms of a dimming signal, a total driving current flowing in a plurality of LED groups, and a current flowing in each LED group.

Referring to FIG. 7, a dimming signal 700 is applied to the respective switches 401 for driving one LED group 301 in t0~t1 and t5~t6, driving two LED groups 301 in t1~t2 and t4~t5, and driving three LED groups 301 in t2~t4.

In this regard, a total driving current Itot 701 has a level of Iref in t0~t1 and t5~t6, a level of 2Iref in t1~t2 and t4~t5, and a level of 3Iref in t2~t4.

Further, a current 703 flowing in each LED group 301 also changes as the dimming signal 700 applied to each switch 401 changes. If the dimming signal DIM1 is applied for driving one LED group 301 in t0~t3, a level of a current i1 flowing in the corresponding LED group 301 is maintained within the same time. Likewise, the dimming signals DIM2~DIM4 are synchronized with the currents i2~i4. However, the currents shown in FIG. 7 are ideal; thus, practical currents will be described below.

Figure 8:
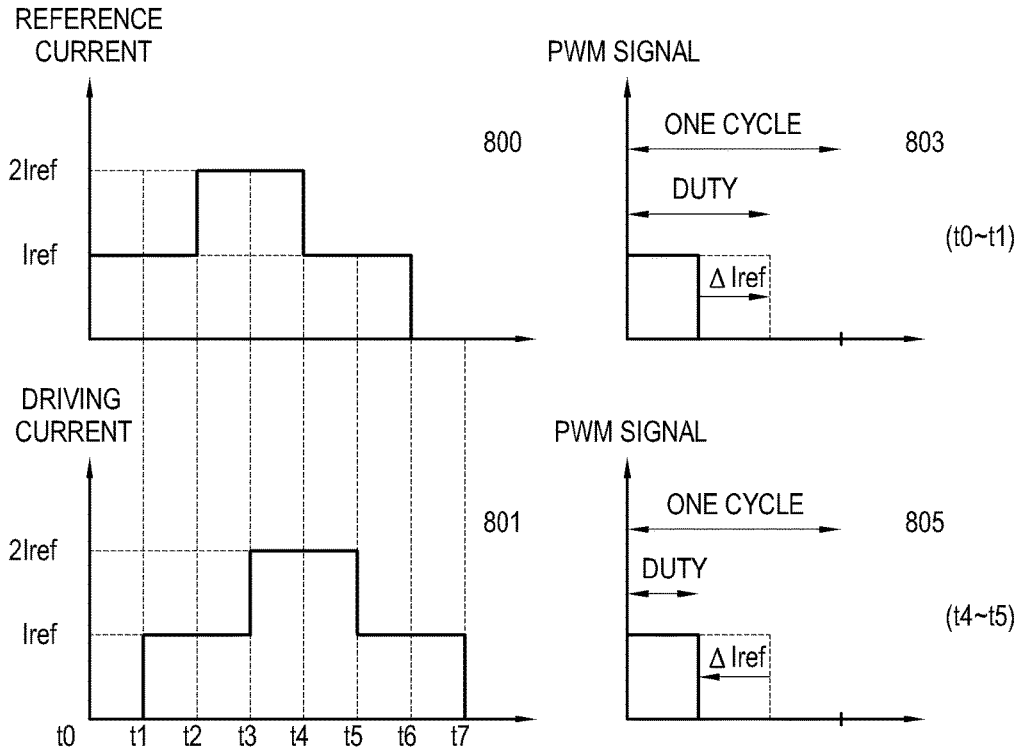
FIG. 8 illustrates an example change in waveforms of a pulse width modulation (PWM) signal output from a signal output in accordance with change in level of a reference current and the total driving current.

FIG. 8 illustrates an example change in waveforms of a control signal due to change in the level of the total driving current Itot and the level of the reference current Iref. In this example embodiment, the control signal output from the signal output 512 may be a PWM signal having duty cycle corresponding to difference in level between the reference current Iref and the driving current Itot within one cycle as described above.

In t0~t1, any one of the LED group 301 has not been driven yet after the input of the dimming signal for driving one LED group 301. Since the LED group 301 has not been driven yet, the total driving current Itot 801 has a level of 0. The reference current Iref 800 generated by the counter 511 and the mixer 510 has a level of IRef corresponding to the dimming signal, and the amplifier 513 compares the level of the reference current Iref 800 and the level of the total driving current Itot 801. Since the level of the reference current Iref 800 is higher by IRef than the level of the total driving current Itot 801, the amplifier 513 outputs the differential signal corresponding to the level of +IRef. The signal output 512 outputs a PWM signal 803, of which duty cycle is widened by +IRef based on the differential signal, to the voltage adjuster 400. In response to the input of the PWM signal 803, the voltage adjuster 400 raises the level of the driving voltage to be applied to the LED groups 301. As the level of the driving voltage is raised, the level of the total driving current Itot 801 flowing in the LED group 301 increases from 0 to IRef. The total driving current Itot 801 having an increased level flows in one LED group 301 of which the current path is formed in accordance with the switching operation of the switch 401. Therefore, the LED group 301, in which the current flows, emits light.

In t4~t5, two LED groups 301 are still driven after the input of the dimming signal for driving only one LED group 301 while two LED groups 301 are being driven. The reference current Iref 800 generated by the counter 511 and the mixer 510 has a level of IRef corresponding to the dimming signal, and the amplifier 513 compares the level of the reference current Iref 800 and the level of the total driving current Itot 801. Since the level of the total driving current Itot 801 is higher by IRef than the level of the reference current Iref 800, the amplifier 513 outputs the differential signal corresponding to the level of −IRef. The signal output 512 outputs a PWM signal 805, of which duty cycle is narrowed by −IRef based on the differential signal, to the voltage adjusting circuitry 400. In response to the input of the PWM signal 805, the voltage adjusting circuitry 400 drops the level of the driving voltage to be applied to the LED groups 301. As the level of the driving voltage is dropped, the level of the total driving current Itot 801 flowing in the LED group 301 decreases from 2*IRef to IRef. The total driving current Itot 801 having a decreased level flows in only one LED group 301 of which the current path is formed in accordance with the switching operation of the switch 401, and does not flow in the LED group 301 of which the current path is cut off. Therefore, only the LED group 301, in which the current flows, emits light.

Figure 9:
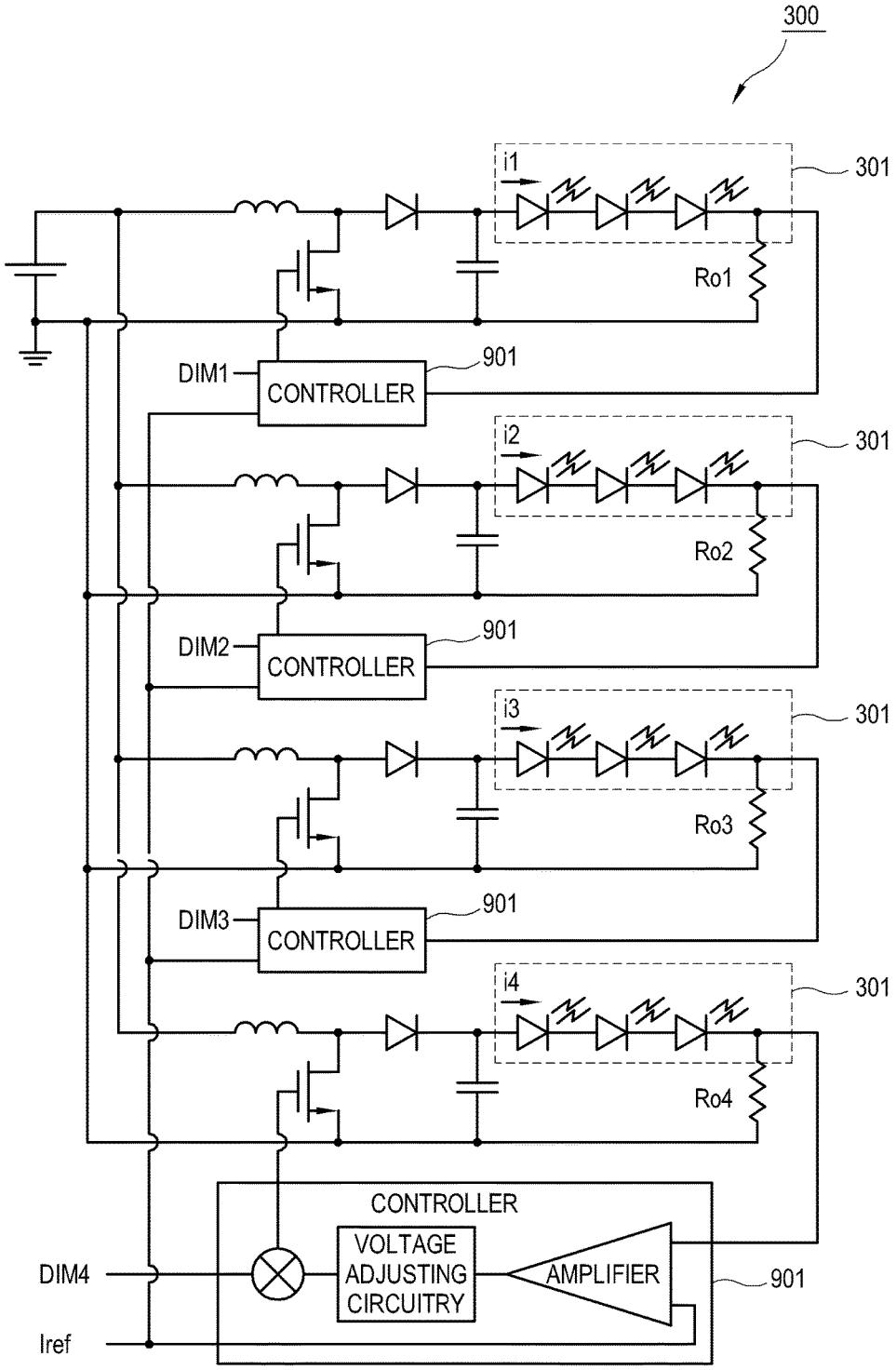
FIG. 9 is a circuit diagram illustrating an example LED driving circuit.
Figure 10:
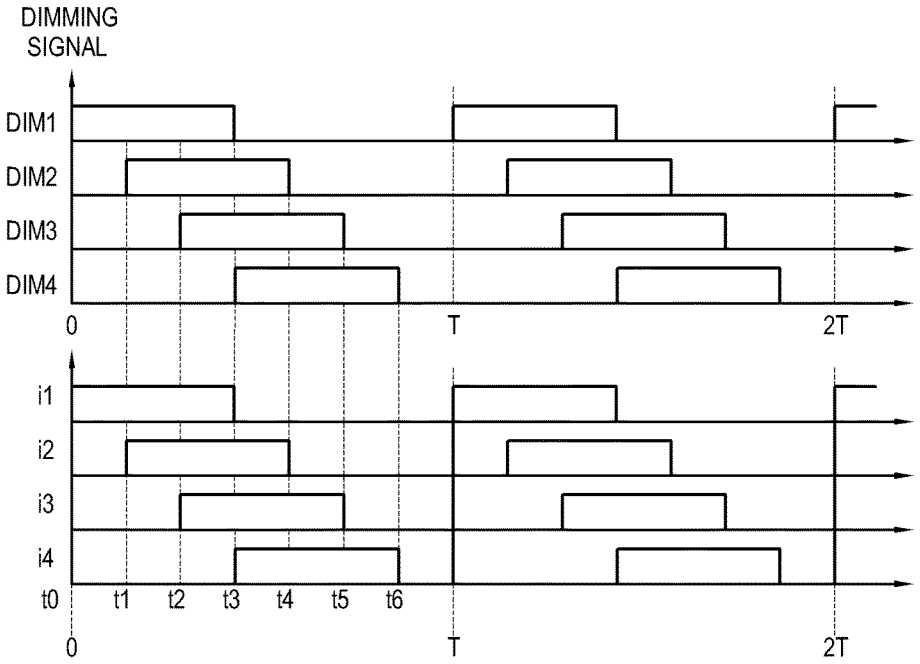
FIG. 10 illustrates an example change in waveforms of the dimming signal and the current flowing in each LED group.

FIGS. 9 and 10 illustrate an example circuit diagram and operation waveforms of the LED driving circuit, in which the controller is provided per block.

The LED driving circuit 300 according to the comparative example is also a device for driving local dimming of the LED groups 301. Referring to FIG. 9, the LED driving circuit 300 includes controllers 901 configured to control a plurality of LED groups 301, respectively. Each of the controllers 901 is configured to selectively drive the corresponding LED group 301 in response to an input of a dimming signal.

Referring to FIG. 10, the dimming signal input to the LED driving circuit 300 according to the comparative example is synchronized with the driving current flowing in each LED group 301 in accordance with the dimming signal. The controller 901 is provided per LED group 301, so that the driving currents i1, i2, i3 and i4 corresponding to the level of the basic reference current Iref can flow in each LED group 301 in response to the input of the dimming signal and can be cut off by no dimming signal.

In comparison between the waveforms of FIG. 7 and the waveforms of FIG. 10, there is no difference in the current flowing in each LED group 301 between the present example embodiment where one controller performs the dimming control for the plurality of LED groups 301 and the comparative example where the controllers 901 are provided in the respective LED groups 301.

In the case where the LED groups 301 are respectively provided with the controllers 901, circuits become more complicated as the number of LED groups 301 increases, and material cost increases at an exponential rate since the number of elements increases.

Figure 11:
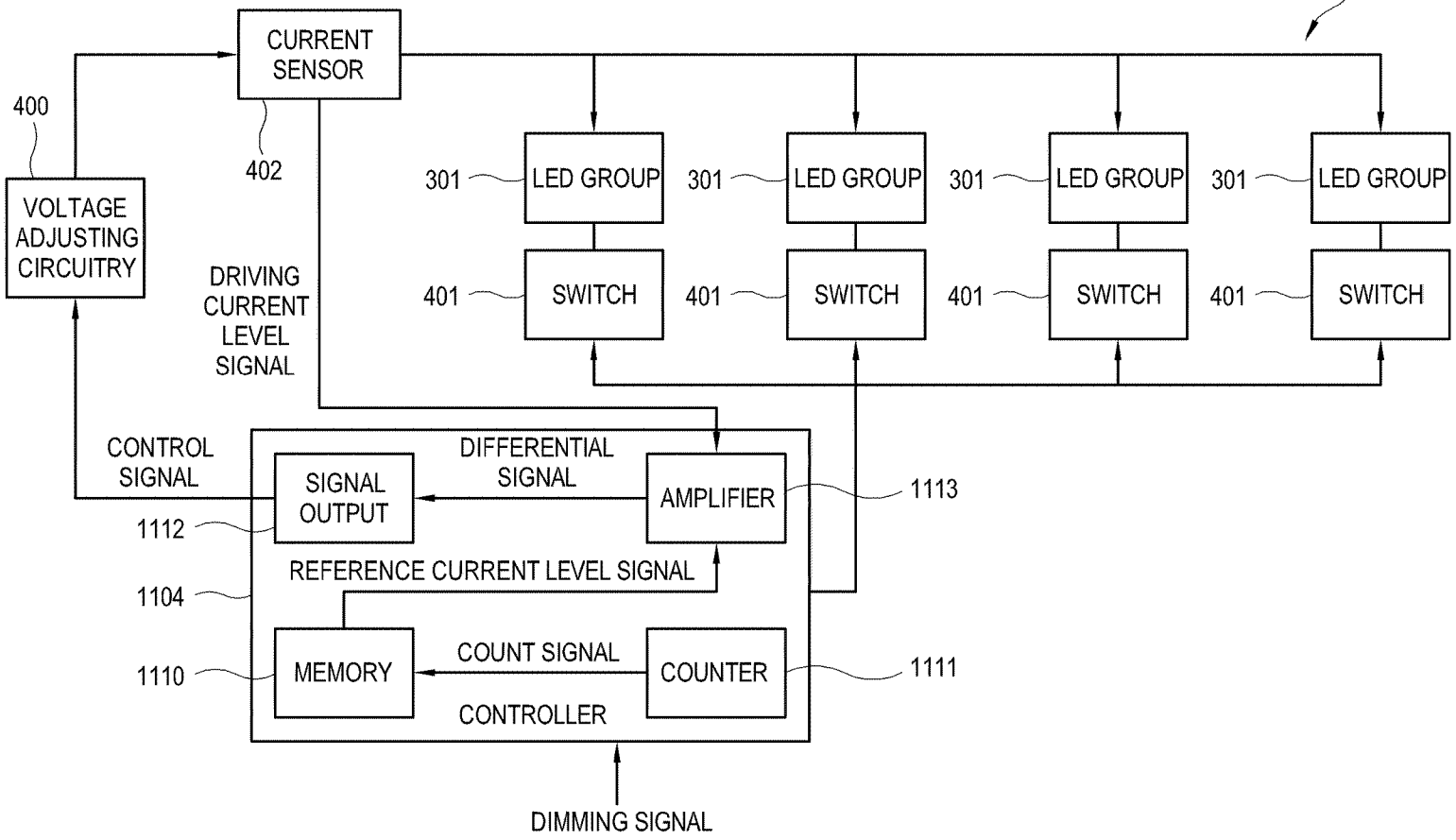
FIG. 11 is a block diagram illustrating an example LED driving circuit with a memory.
Figure 12:
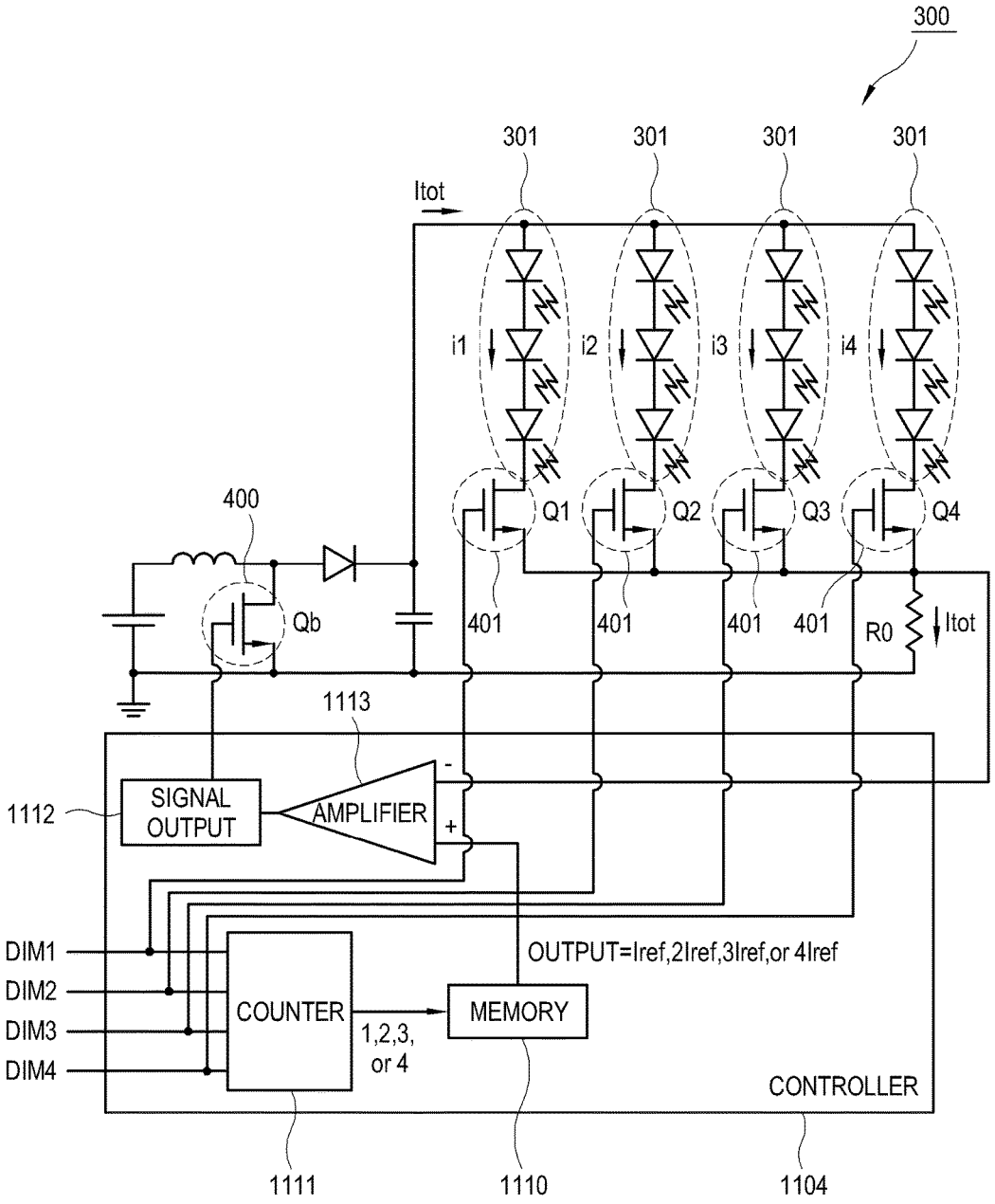
FIG. 12 is a circuit diagram illustrating an example LED driving circuit with a memory.

FIGS. 11 and 12 are a block diagram and a circuit diagram illustrating an example LED driving circuit with a memory, which previously stores a reference current level.

In this example embodiment, a controller 1104 of the LED driving circuit 300 is also configured to control the voltage adjusting circuitry 400 to adjust the level of the driving voltage based on the number of LED groups 301 to be driven and the sensed level of the total driving current Itot.

The controller 1104 according to an example embodiment includes a counter 1111, an amplifier 1113 and a signal output 1112, and a memory 1110 which stores information about the level of the reference current Iref without an input of the basic reference current level signal.

The memory 1110 does not receive the basic reference current level signal, but stores the level of the reference current Iref corresponding to a counted value. In response to the input of a count signal corresponding to the counted value from the counter 1111, the memory 1110 generates the level of the reference current Iref corresponding to the counted value, and outputs the reference current level signal to the amplifier 1113.

Figure 13:
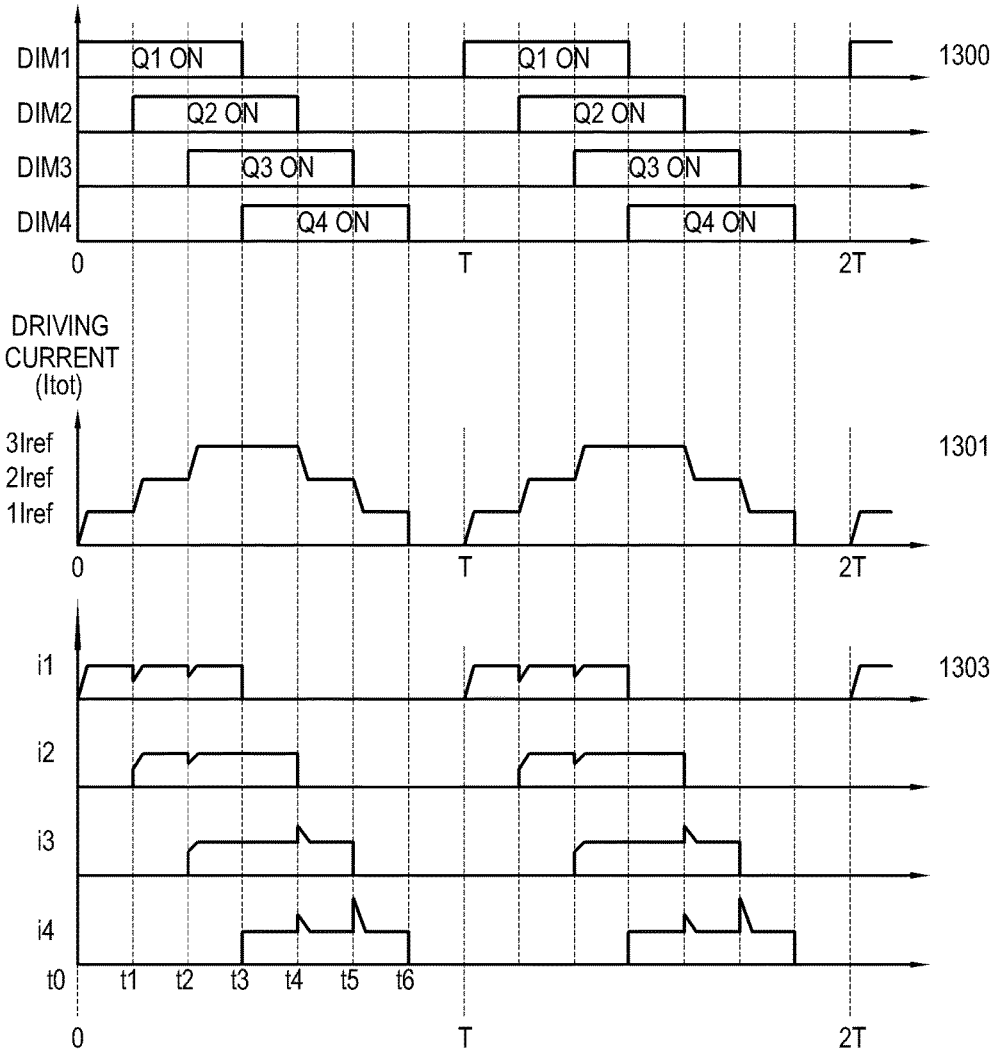
FIG. 13 illustrates an example of real change in waveforms of the dimming signal, the total driving current and the current flowing in each LED group.

FIG. 13 illustrates an example real change in waveforms of the dimming signal of the LED driving circuit, the total driving current flowing in the plurality of LED group, and the current flowing in each LED group.

A switch 401 forms or cuts off a current path with little delay in response to the input of a dimming signal 1300. However, since the driving current Itot is changed by, generating a new level of the reference current Iref, comparing the generated level and the driving current Itot, and adjusting the driving voltage when the number of LED groups 301 is changed, it is delayed for a predetermined time from switch timing.

As the increase of the total driving current Itot 1301 is delayed at t0, t1 and t2, the level of the current 1303 flowing in each LED group 301 is also slowly increased with a little delay, but this does not cause a serious problem.

However, the decrease of the total driving current Itot 1301 is delayed as the dimming signal 1300 is terminated at t4 and t5 and the switch 401 first cuts off the current path of the LED group 301, and therefore a current having the higher level than the required current is suddenly applied to the LED group 301 being driven. It can be a problem since such a current or a spark may be hard on an electronic device such as the LED, and may cause a trouble in the LED.

Figure 14:
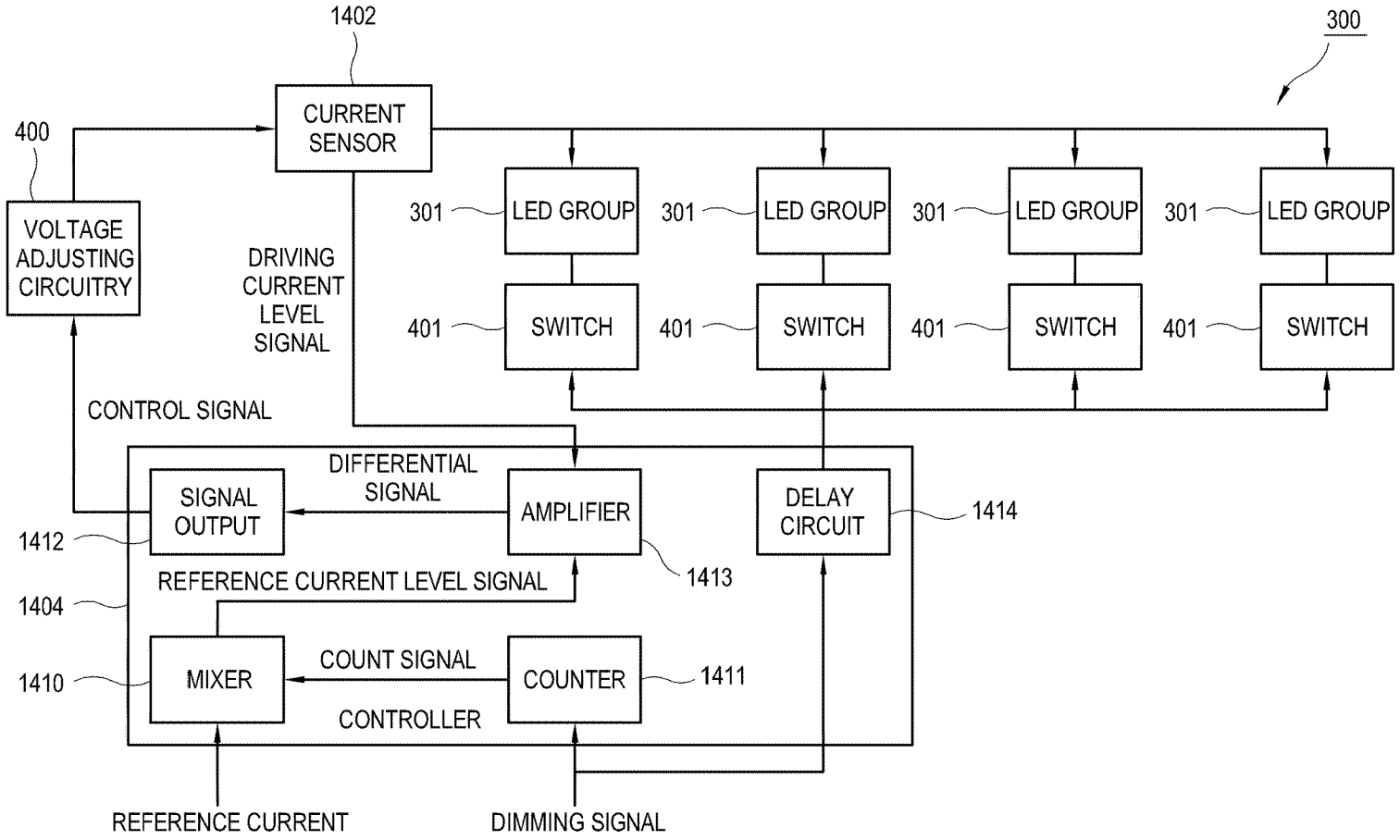
FIG. 14 is a block diagram illustrating an example LED driving circuit with a delay circuit.
Figure 15:
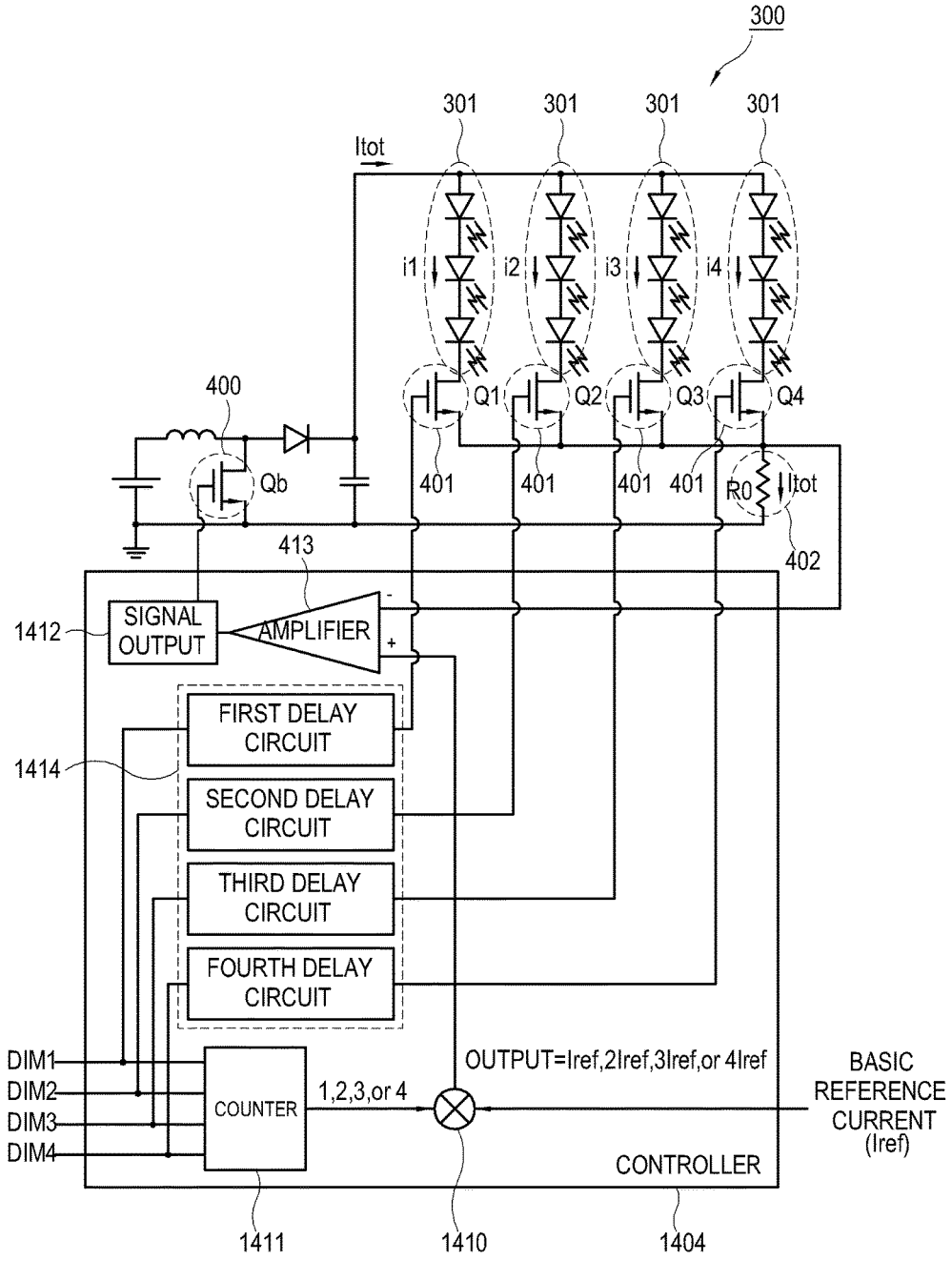
FIG. 15 is a circuit diagram illustrating an example LED driving circuit with the delay circuit.
Figure 16:
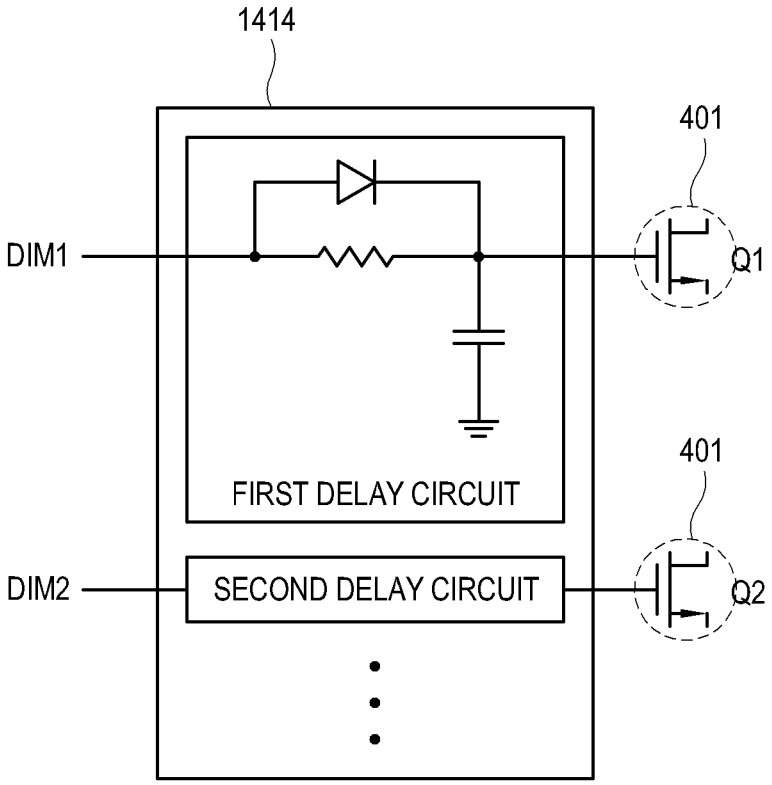
FIG. 16 is a circuit diagram illustrating an example delay circuit.

FIGS. 14 and 15 are a block diagram and a circuit diagram illustrating an example LED driving circuit which further includes a delay circuit 1414 to address the foregoing problems associated with above delays. FIG. 16 illustrates an example circuit diagram of the delay circuit 1414.

In this example embodiment, the LED driving circuit 300 further includes a delay circuit 1414 that delays timing of opening and closing the switch 401 for a predetermined time. The switch 401 is opened or closed to form or cut off the current path of the LED group 301. When the number of LED groups 301 to be driven is decreased, the current path of the LED group 301 to be no longer driven is cut off by the switch 401 after the level of the total driving current Itot is completely lowered, thereby performing the switching first and reducing and/or preventing a spark from occurring in the LED group 301 being driven.

In this example embodiment, the delay circuit 1414 may be configured to delay the operations of opening and closing the switch 401 for a predetermined time even though the dimming signal is no longer input to the switch 401 after the dimming signal has been input to the switch 401 for a while, to this end, a resistor-capacitor (RC) circuit may be used.

Referring to FIG. 15, an example circuit diagram of the delay circuit 1414 is illustrated. When the dimming signal is input, the signal is input to the switch 401 via a diode connected in parallel with the resistor. When the dimming signal is terminated, a charged capacitor provides a predetermined amount of electric charges and therefore the switch 401 does not cut off the current path until the capacitor is discharged.

Figure 17:
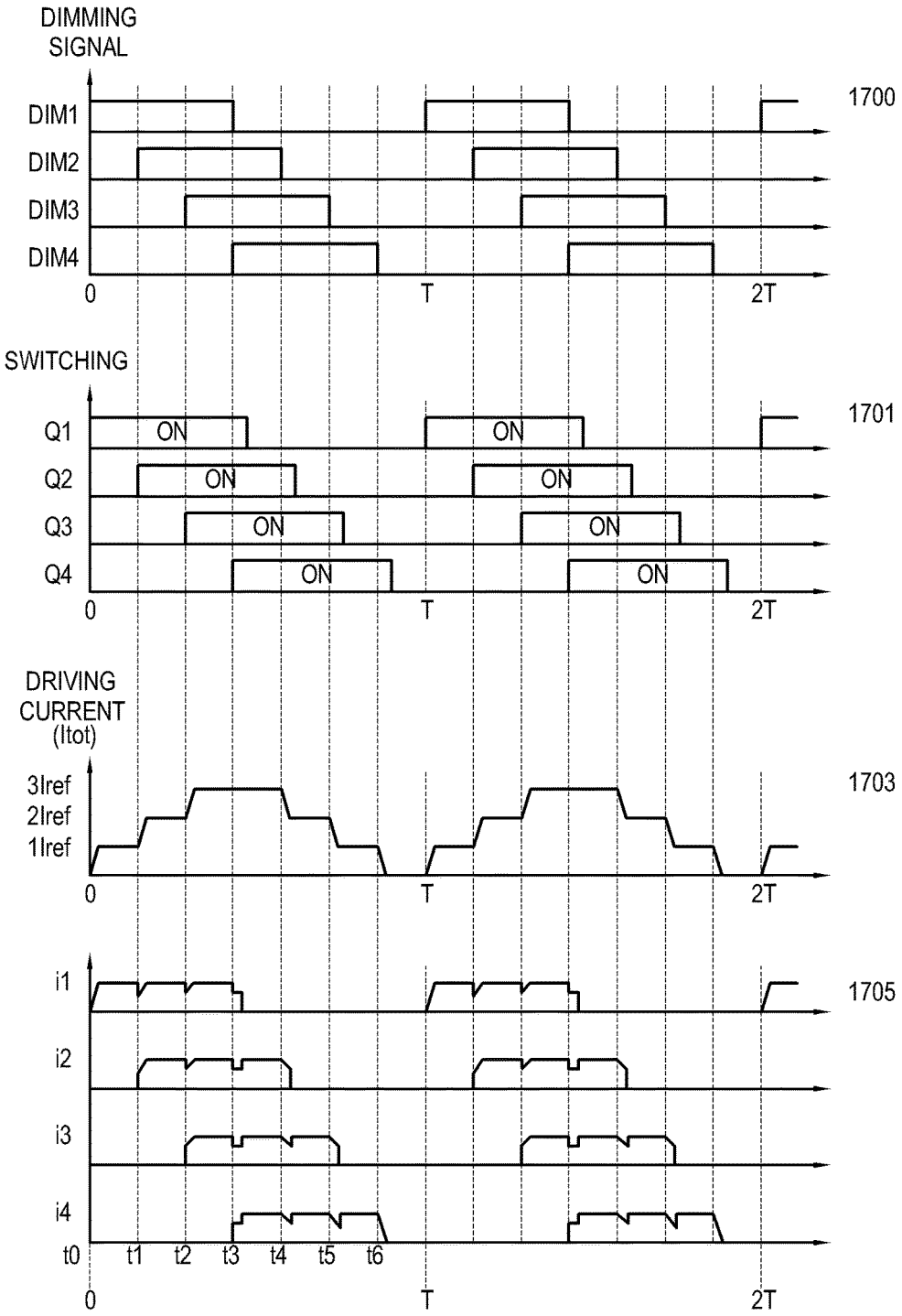
FIG. 17 illustrates an example of a real change in waveforms of the dimming signal, the total driving current, and the current flowing in each LED group, which are changed due to the delay circuit.

FIG. 17 illustrates an example real change in waveforms of the dimming signal, the total driving current flowing in the plurality of LED groups, and the current flowing in each LED group, which are changed due to the delay circuit At t3, t4, t5 and t6, the switch 401 does not instantly cut off the current path at the same time when the dimming signal is terminated, but cuts off the current path after a predetermined time elapses and the level of the total driving current Itot is lowered by one step. Thus, it is possible to reduce and/or remove the spark of FIG. 13.

Figure 18:
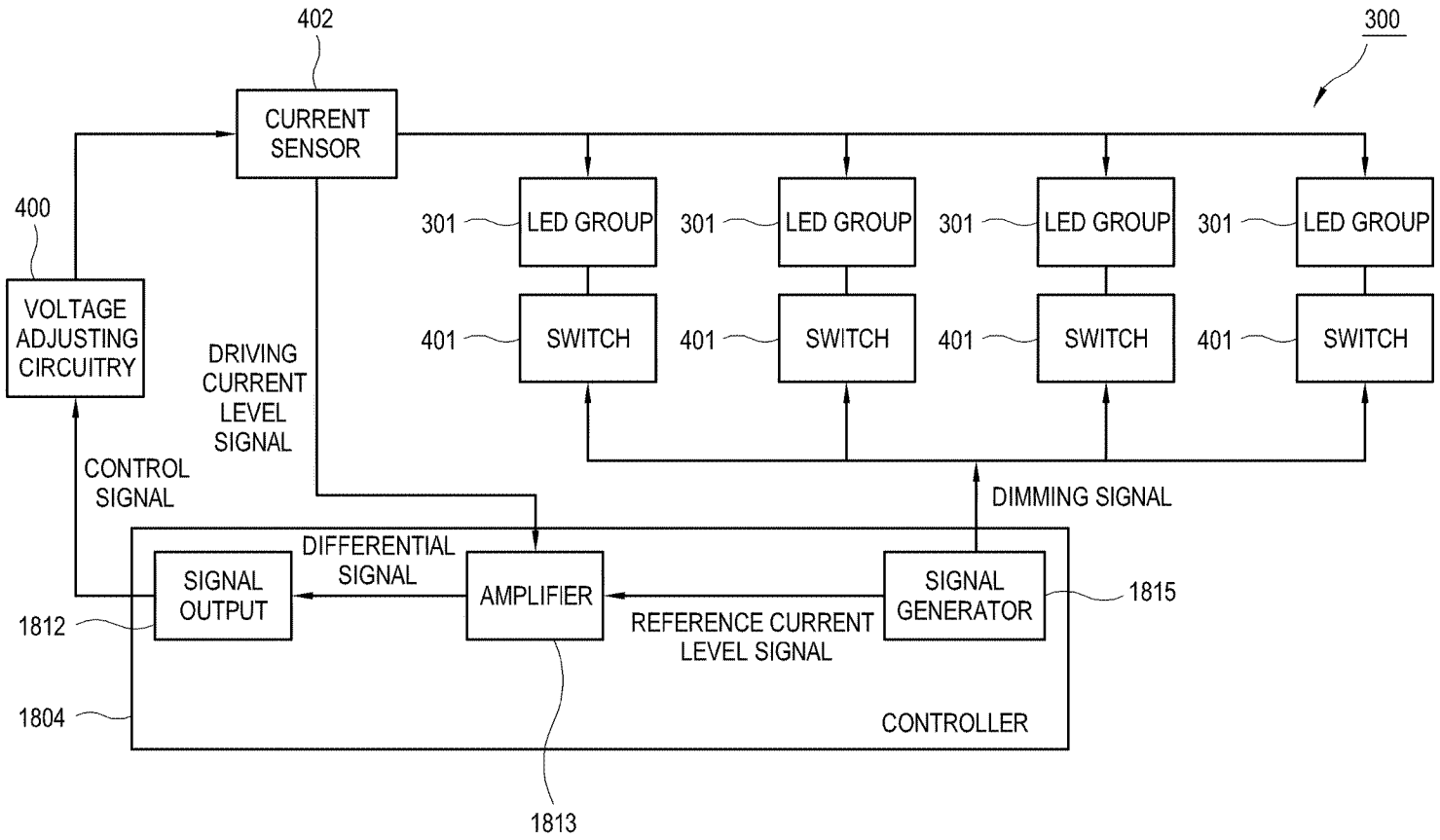
FIG. 18 is a block diagram illustrating an example LED driving circuit with a signal generator.
Figure 19:
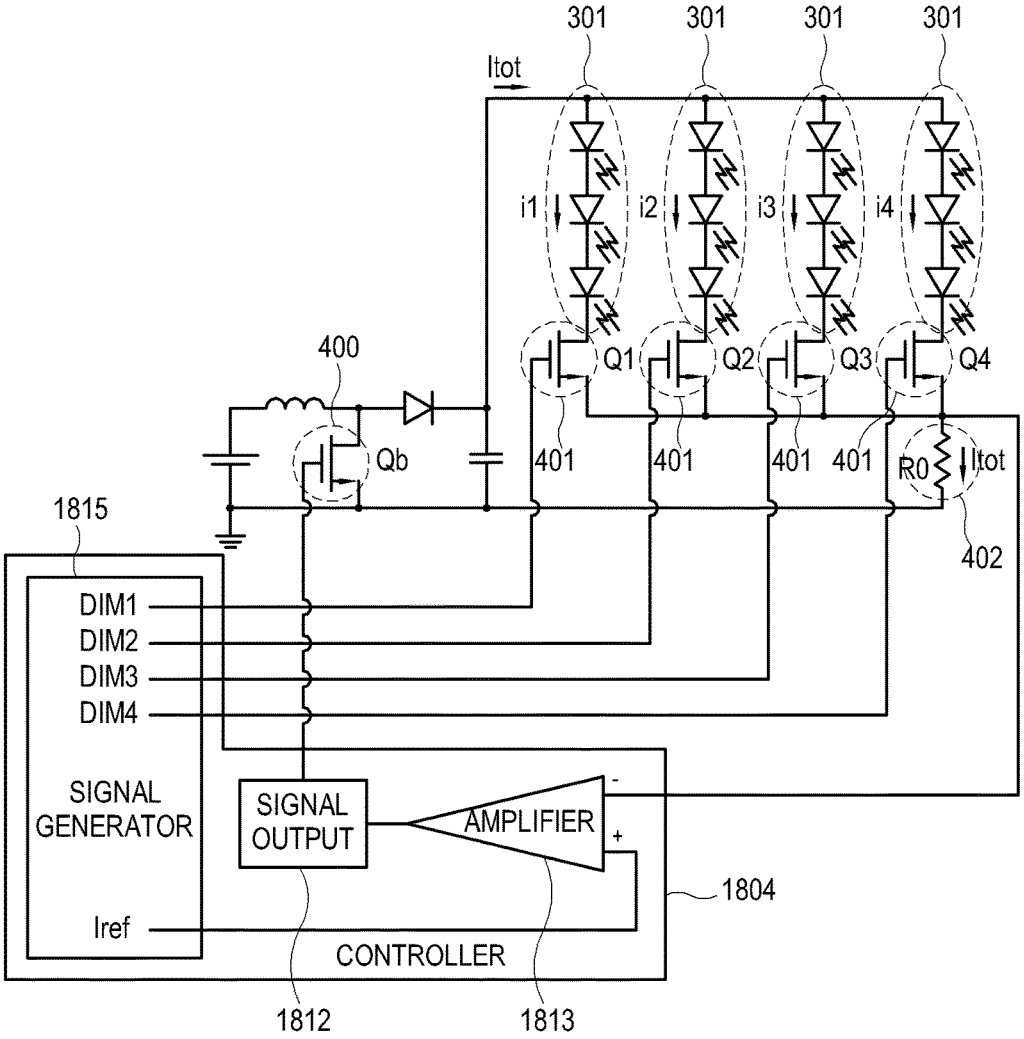
FIG. 19 is a circuit diagram illustrating an example LED driving circuit with a signal generator.

FIGS. 18 and 19 are a block diagram and a circuit diagram illustrating an example LED driving circuit with a signal generator.

The LED driving circuit 300 may further include a signal generator 1815 for providing the dimming signal and the reference current level signal. The signal generator 1815 may correspond to a first control signal output or a second control signal output described herein.

In this example embodiment, the signal generator 1815 may provide the dimming signal and the basic reference current level signal. The switch 401 is opened and closed in response to the dimming signal received from the signal generator 1815, thereby selectively forming a path of the driving current. The amplifier 1813 compares the reference current level signal received from the signal generator 1815 and the driving current level signal received from the current sensor 402 and outputs a differential signal to the signal output 1812. The signal output 1812 provides a control signal based on the differential signal to the voltage adjusting circuitry 400. Based on the control signal, the voltage adjusting circuitry 400 adjusts the driving voltage applied to the LED groups 301.

According to an example embodiment, the signal generator 1815 provides not only the dimming signal but also the reference current level signal based on the number of the LED groups 301 to be driven.

Figure 20:
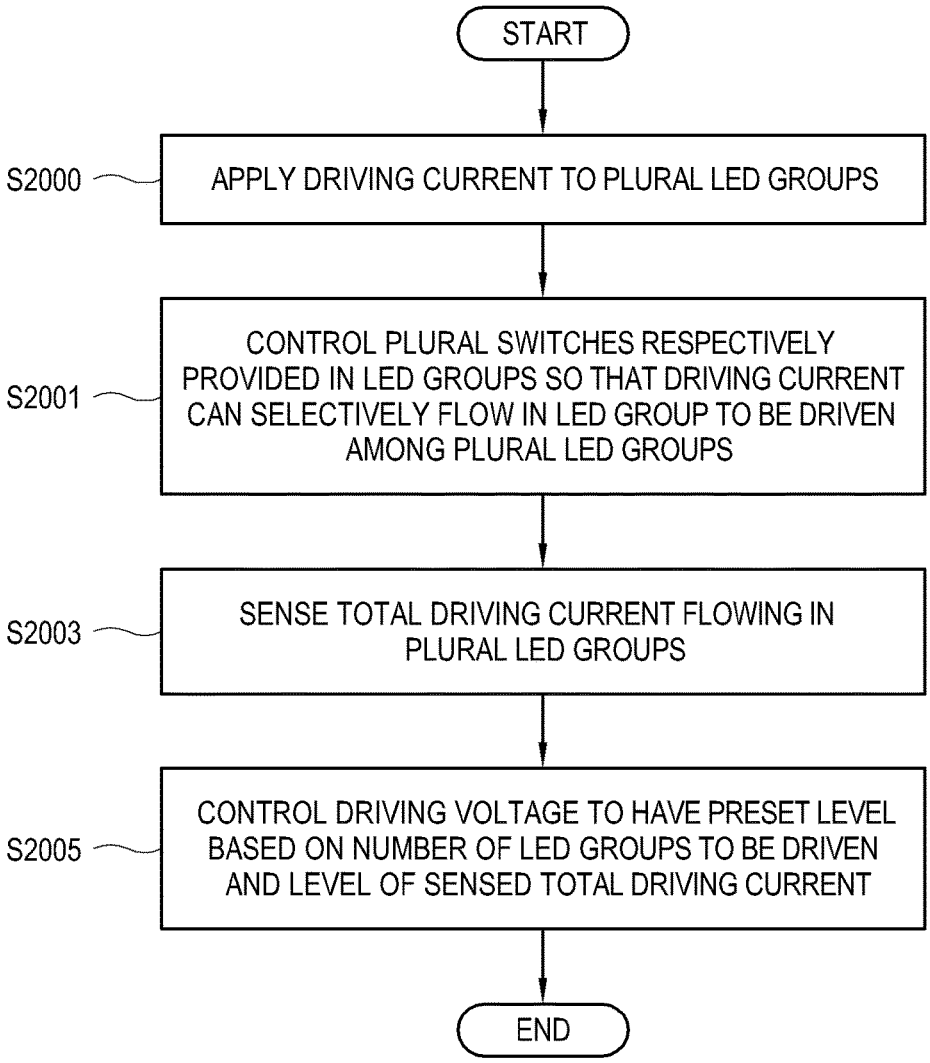
FIG. 20 is a flowchart illustrating an example of controlling each LED group for local dimming of the backlight unit in the display apparatus.

FIG. 20 is a flowchart illustrating an example of controlling each LED group for local dimming in the display apparatus.

At operation S2000, the driving voltage is applied to the plurality of LED groups 301. At operation S2001, the plurality of switches 401 provided in the respective LED groups 301 is controlled so that the driving current can selectively flow in the LED group 301 to be driven among the plurality of LED groups 301. At operation S2003, the total driving current Itot flowing in the plurality of LED groups 301 is sensed. Ay operation S2005, the driving voltage is controlled to have a preset level based on the number of LED groups 301 to be driven and the sensed level of total driving current Itot.

As described above, the respective sectioned blocks of the backlight are efficiently controlled by the single controller for the local dimming, thereby simplifying the circuit and reducing material costs.

Although various example embodiments have been shown and described, it will be appreciated by those skilled in the art that changes may be made in these example embodiments without departing from the principles and spirit of the disclosure, the scope of which is defined in the appended claims and their equivalents.

What is claimed is:

1. A display apparatus comprising:

a signal receiver configured to receive an image signal;

a signal processor configured to process the received image signal;

a display comprising: a display panel which displays an image based on the processed image signal; and a plurality of light emitting diode (LED) groups each comprising a plurality of LEDs connected in series, the plurality of LED groups being connected in parallel with each other to emit light for an image to be displayed on the panel based on a driving current;

a plurality of switches provided for each LED group and selectively cutting off flow of a driving current to each LED group;

voltage adjusting circuitry configured to apply a driving voltage to the plurality of LED groups; and a controller configured to:

control the plurality of switches to provide driving current to the LED group to be driven among the plurality of LED groups, identify a difference between a reference current corresponding to the number of LED groups to be driven and a total driving current flowing in the plurality of LED groups, and control the voltage adjusting circuitry to adjust the applied driving voltage.

2. The display apparatus according to claim 1, wherein the controller is configured to generate the reference current to have a level corresponding to the number of LED groups to be driven, based on a combination of a basic level of the reference current and a counted value corresponding to the number of LED groups to be driven.

3. The display apparatus according to claim 2, wherein the controller comprises a mixer configured to receive a count signal corresponding to the counted value and a basic level signal corresponding to a basic level of the reference current, and to output a reference current level signal corresponding to the count signal and the level of the reference current.

4. The display apparatus according to claim 2, wherein the controller comprises a memory configured to store information about the level of the reference current corresponding to the number of LED groups to be driven.

5. The display apparatus according to claim 2, wherein the controller comprises a first control signal output configured to output a plurality of switching control signals for controlling the plurality of switches corresponding to the LED groups to be driven.

6. The display apparatus according to claim 5, wherein the first control signal output further outputs a level signal corresponding to the level of the generated reference current.

7. The display apparatus according to claim 2, wherein the controller further comprises a counter configured to count the number of LED groups to be driven.

8. The display apparatus according to claim 1, wherein the controller comprises:

an amplifier configured to output a differential signal having a level corresponding to a difference between a level corresponding to the reference current and a level corresponding to the sensed total driving current; and a second control signal output configured to output a second control signal to the voltage adjusting circuitry to adjust a level of the driving voltage based on the level of the differential signal.

9. The display apparatus according to claim 8, wherein the control signal comprises a pulse width modulation (PWM) signal having duty cycle corresponding to the level of the differential signal.

10. The display apparatus according to claim 1, wherein the controller further comprises a delay circuit configured to delay timing of opening and closing the plurality of switches for a predetermined time.

11. The display apparatus according to claim 1, wherein the controller further comprises a delay circuit configured to delay at least one of opening timing and closing timing for the plurality of switches.

12. The display apparatus according to claim 11, wherein the delay circuit is configured to delay at least one of the opening timing and the closing timing for the plurality of switches if the number of LEDs to be driven is decreased.

13. A method of controlling a display apparatus comprising a plurality of light emitting diode (LED) groups connected in parallel with each other and emitting light for an image display based on a driving current, and a driving circuit for driving the plurality of LED groups, the method comprising:

applying a driving voltage to the plurality of LED groups;

controlling a plurality of switches respectively provided in the LED groups so that a driving current can selectively flow in an LED group to be driven among the plurality of LED groups;

identifying a reference current corresponding to the number of LED groups to be driven;

sensing a total driving current flowing in the plurality of LED groups;

identifying a difference between the reference current and the sensed total driving current; and controlling the applied driving voltage based on the difference.

14. The method according to claim 13, wherein the applied driving voltage comprises generating the reference current to have a level corresponding to the number of LED groups to be driven, based on a combination of a basic level of the reference current and a counted value corresponding to the number of LED groups to be driven.

15. The method according to claim 14, wherein generating the reference current comprises:

receiving a count signal corresponding to the counted value and a basic level signal corresponding to a basic level of the reference current; and outputting a reference current level signal corresponding to the level of the reference current.

16. The method according to claim 14, wherein generating the reference current comprises storing information about the level of the reference current corresponding to the number of LED groups to be driven.

17. The method according to claim 14, wherein controlling the level of the driving voltage comprises outputting a plurality of switching control signals for controlling the plurality of switches corresponding to the LED groups to be driven.

18. The method according to claim 17, wherein controlling the level of the driving voltage comprises outputting a level signal corresponding to the level of the generated reference current.

19. The method according to claim 14, wherein generating the reference current comprises counting the number of LED groups to be driven.

20. The method according to claim 13, wherein controlling the level of the driving voltage comprises:

outputting a differential signal having a level corresponding to a difference between a level corresponding to the reference current and a level corresponding to the sensed total driving current; and outputting a control signal to adjust a level of the driving voltage based on the level of the differential signal.

21. The method according to claim 13, wherein controlling the plurality of switches comprises delaying at least one of opening timing and closing timing for the plurality of switches.

22. A light emitting diode (LED) driving circuit to drive a plurality of LED groups used as a light source for a display apparatus each of the LED groups comprising a plurality of LEDs connected in series and each LED group being connected in parallel with each other to emit light for an image to be displayed on the display apparatus in accordance with a driving current, the LED driving circuit comprising:

a plurality of switches configured to be respectively provided in each of the LED groups and to selectively cut off flow of a driving current in each LED group;

voltage adjusting circuitry configured to apply a driving voltage to the plurality of LED groups; and a controller configured to:

control the plurality of switches so that the driving current can flow in the LED group to be driven among the plurality of LED groups, identify a difference between a reference current corresponding to the number of LED groups to be driven and a total driving current flowing in the plurality of LED groups, and control the voltage adjusting circuitry to adjust the applied driving voltage based on the difference.

* * * * *